US005816590A

United States Patent [19]

Fey et al.

[11] Patent Number: 5,816,590

[45] Date of Patent: Oct. 6, 1998

[54] NORDIC SKIBOARD

[75] Inventors: Martin J. Fey, Putnam, Conn.; Erik W. Fey, Penacook, N.H.; Marie L. Franzino, Putnam, Conn.

[73] Assignee: Uniboard Corporation, Putnam, Conn.

[21] Appl. No.: 831,244

[22] Filed: Apr. 2, 1997

[51] Int. Cl.[6] ..... A63C 5/00

[52] U.S. Cl. ..... 280/14.2; 280/615

[58] Field of Search ..... 280/611, 614, 280/615, 616, 617, 618, 633, 607, 14.2, 634

[56] References Cited

U.S. PATENT DOCUMENTS

| | | | |
|---|---|---|---|
| 3,154,312 | 10/1964 | Marchand | 280/14.2 |
| 3,171,667 | 3/1965 | Wightman | 280/21 |
| 4,275,905 | 6/1981 | Pederson | 280/818 |
| 4,403,785 | 9/1983 | Hottel | 280/12 H |
| 4,969,655 | 11/1990 | Katz | 280/14.2 |
| 4,995,631 | 2/1991 | Hunter | 280/607 |
| 5,096,217 | 3/1992 | Hunter | 280/607 |
| 5,354,088 | 10/1994 | Vetter et al. | 280/618 |
| 5,413,373 | 5/1995 | Evans | 280/620 |
| 5,505,478 | 4/1996 | Napiello | 280/14.2 |
| 5,538,272 | 7/1996 | Peart | 280/602 |
| 5,551,728 | 9/1996 | Barthel | 280/818 |
| 5,553,883 | 9/1996 | Erb | 280/14.2 |
| 5,573,264 | 11/1996 | Deville et al. | 280/602 |
| 5,577,755 | 11/1996 | Metzger et al. | 280/14.2 |
| 5,584,492 | 12/1996 | Fardie | 280/14.2 |
| 5,586,779 | 12/1996 | Daves et al. | 280/14.2 |
| 5,649,722 | 7/1997 | Champlin | 280/818 |
| 5,655,786 | 8/1997 | Rastogianis | 280/14.2 |

FOREIGN PATENT DOCUMENTS

| | | | |
|---|---|---|---|
| 0362782 | 10/1989 | European Pat. Off. | A63C 5/03 |
| 535818 | 10/1931 | Germany | 280/636 |

*Primary Examiner*—Richard M. Camby
*Attorney, Agent, or Firm*—James T. Sullivan

[57] ABSTRACT

A skiboard system is provided. The system includes a skiboard and left and right loose heel binding secured to the skiboard. The skiboard has a longitudinal axis, a central portion and an upward curving front shovel area. The central portion includes side edges and a central waist. The side edges have concave curvatures of radius and extend between front and rear ends of the central portion so that the concave curvatures of the side edges form the central waist. The central portion further includes a longitudinal camber, which elevates the waist. The upward curving front shovel area has a front tip and is formed by the front end of the central portion. The left and right loose heel bindings are secured to the central portion substantially parallel to each other on opposite sides of the waist at an acute angle less than 35 degrees from the longitudinal axis. Furthermore, the bindings are angled to the right of the longitudinal axis when the left binding is in front of the waist and the bindings are angled to the left of the longitudinal axis when said right binding is secured in front of the waist.

5 Claims, 11 Drawing Sheets

NORDIC SKIBOARD

FIELD OF INVENTION

This invention creates a new snow sport, Nordic skiboarding. The Nordic skiboard described here is relatively narrow, light-weight and extremely maneuverable. It employs two Nordic or telemark bindings fixed in fore-and-aft positions at relatively parallel acute angles on a single board. Nordic skiboarding combines elements of snowboarding, Alpine Skiing, Nordic Skiing and mono-skiing.

BACKGROUND OF THE INVENTION AND PRIOR ART KNOWN

Telemark Skiing

Skiing began centuries ago in Scandinavia as a way to travel on foot over snow. It was largely unknown in other parts of Europe until it was introduced in the Alps as a novelty in the latter half of the 1800s. At that time, skis were primarily used for gliding over relatively flat terrain, and in fact were sometimes referred to as "Norwegian snowshoes." Their length—up to 12 feet or longer—made them virtually impossible to turn on steep downhill runs.

As skis became more recreational then utilitarian, they were made shorter and became more manageable. It became possible to execute downhill turns on them using a technique developed in the village of Telemark, Norway. This technique, which became known as the telemark turn, required dropping one knee and extending the other leg forward at an angle in the direction of the turn. The bindings, usually simply a leather strap that crossed the toe of the boot, allowed the heel to rise off the board. This had three functions: it allowed the skier to get up on the ball of the foot to execute the knee dip required for the telemark turn; it allowed enough movement to reduce the likelihood of leg injury in the event of a fall; and it allowed the skier to "walk" on the skis, like snowshoes, over flat areas and up hills.

Nordic vs. Alpine

Loose-heel bindings—now called Nordic or telemark bindings—were the rule in the early days of downhill skiing, in part because skiing required hiking up the mountain before gliding down it. In the 1930s, the first rope tows were installed in the U.S. and the new stem christy, or "wedge turn", supplanted the graceful, but more difficult, telemark turn. With no need to walk up hills or to dip a knee to turn, there was no longer a need to keep the skier's heel free. The releasable, lock-down binding appeared, and boots became stiffer and higher until hard-shell plastic models became the rule in the 1970s. Telemarking and loose-heel skiing went into eclipse.

In recent years, there has been a resurgence in telemark skiing. Improvements in boots, combined with an appreciation for the weight-shifting advantages of loose-heel bindings in soft snow, have made telemarking a fast-growing sport. Despite the relative difficulty of the technique—or perhaps in part because of it—telemark skiers have become a common sight even at lift-served areas.

Traditional Mono-Skis

Ironically, while ski lifts obviated the need for "walking" on skis, and thus nearly eliminated the loose-heel or Nordic binding from the ski scene, there was no effort to get away from having an independent ski on each foot until the 1960s. In that decade, several permutations of the mono-ski appeared, like that of Jacques Marchand, May 11, 1961, U.S. Pat. No. 3,154,312, in which the bindings were set side-by-side. The intent was to put the skier in the approximate position he or she would be in if wearing two skis that were held tightly parallel.

This arrangement presents a serious problem, however. The side by-side binding set-up, wing traditional Alpine ski boots and lock down, releasable bindings, does not permit the skier to apply weight heavily to either edge. This is especially significant because the total length of edge on a typical mono-ski is short, and is half what it would be on dual skis of the same length. While such mono-skis function adequately in soft snow conditions, they have failed to capture an appreciable share of the ski market because control on hard-packed snow or ice is very difficult with the side-by-side binding configuration. The mono-ski of Kent Hunter, Feb. 26, 1991, U.S. Pat. No. 4,995,631, discloses an attempt to deal with this problem by adding severe sidecut, or arcs, to the sides of a mono-ski, however, the stance remains side-by-side, which prevents the skier from putting full weight on the operational edge. In addition, the lock-down Alpine bindings on the Hunter ski and similar mono-skis, combined with the narrow stance, make falls likely even with temporary losses of balance, because the rider cannot shift weight through a wide forward-backward range.

Ski Connection Systems

Efforts were made over the years to create various mono-skis by linking pairs of conventional Alpine skis using various connecting devices. W. J. Wightman, Apr. 29, 1963, U.S. Pat. No. 3,171,667, offers a ski attachment for connecting a pair of skis and for maintaining the skis close together and parallel as a training aid. Alec Pederson, in Jun. 30, 1981, U.S. Pat. No. 4,275,904, discloses an attachment consisting of a tailbridge connector and a front plate for converting a pair of skis to a "twinski." Fritz Barthel et al, in Sep. 3, 1996 U.S. Pat. No. 5,551,728, describes a "gliding board" device that converts two Alpine skis into a wide mono ski or snowboard by attaching the skis on the sides of a full-length centerpiece.

The common denominator of the Wightman and Pederson connection systems, which are designed to convert two skis into a mono-ski, is that they place the skier's feet in a side-by-side stance. As a result, these divisible mono-ski incarnations present the same edging problem as the solid mono-skis. Barthel makes no suggestions as to how to locate the bindings, or even what type to use, and the large center piece would be impractical to carry in many situations; e.g. when a skier in the back country wants to convert two skis to a single board for control on deep powder or poor snow conditions. The Wightman, Pederson and Barthel systems also involve cumbersome connecting devices that would have to be removed while dual skiing to prevent snags on snows or brush.

Fore-Aft Binding Mono-skis

There are documented efforts to create a mono-ski from a single conventional Alpine ski, with one foot placed ahead of the other. Those employ lock-down Alpine-type bindings set up to accommodate Alpine-type boots.

The "Stic Main" of Erich Genuit, described in Oct. 16, 1931, Deutsches Reich Patent 535818, and the Solo Ski binding system of Robert M. Evans and Franklin G. Miller, described in May 9, 1995 U.S. Pat. No. 5,413,373, offer various methods of converting one ski of a conventional pair into a mono-ski with fore-and-aft binding placement. Typical Alpine bindings and boots are employed in both descriptions, and neither Genuit nor Evans suggest offsetting the bindings at an angle to the axis to the ski. The illustrations in the both patent documents show the bindings in line with the axis of the ski. Traditional Alpine skis are too narrow to permit any significant offset of conventional Alpine bindings, even if it were considered desirable by the designers, because of the length of such binding arrangements, which typically include both a long toe piece and a bulky heel lock-down device.

As stated above, traditional mono-skis have been largely unsuccessful because the rider cannot deliver enough pressure on the edges to execute hard, rapid turns, particularly on hard-packed snow. Genuit's Stic Main and Evans' Solo Ski binding system do not solve this persistent problem, which is compounded by the fact that those systems try to adapt one ski of a downhill ski pair for use as a mono-ski, rather than designing a board for use in conjunction with their fore-and-aft binding arrangements.

The Genuit system includes beveled cuts in the ski that raise the arch side of each foot in relation to the outside of the same foot. Whether this arrangement would actually deliver more power to the edges is unlikely and difficult to ascertain, since then does not appear to be any ski on the market today that employs such a concept. Canting the boots outward in such a fashion would have clear disadvantages, however, making it difficult to bring the knees together in a mutually supporting fashion and making an already narrow and unnatural stance even more unstable, particularly while standing still on the slope.

The Evans Solo Ski binding system is also arranged along the axis of the ski. The front binding is described as a conventional, releasable Alpine ski binding. The rear binding, designed by Evans et al, also accommodates a conventional Alpine ski boot, but in a complex releasable binding that allows both vertical and lateral movement within a rubber cup, similar to the rubber bindings used on water skis. That lateral movement would be a disadvantage, creating instability and reduce the control of a rider attempting a hard, carving turn. Furthermore, the heel of the front foot is fixed in line with the ski, eliminating any possibility of lifting that heel for forward weight shifts and not allowing the application of extra toe or heel pressure on either edge with that foot. The Solo Ski binding system is designed for use on one ski of a conventional ski pair, and for conventional Alpine ski boots. The inflexible, hard-shell boots would not allow the rider to weight the balls of the feet, preventing the rider from accomplishing the dramatic forward-backward weight shifts necessary to adequately control such a long, narrow mono-ski. The lateral movement permitted by the rear binding would reduce control on fast, hard turns.

The use of releasable Alpine bindings on a mono-ski with fore-and-aft bindings also presents a safety problem. If only the front binding releases during a fall, the leg remaining connected to the rear binding may be subject to unusually strong twisting forces from the long end of the ski.

The Problem of Boot Overlap

The traditional mono-ski and the existing fore-and-aft mono-skis also present the problem of boot overlap—that is, the boots and bindings will hang over the edge of the ski. As a result, both boot and binding will drag if the ski is angled sharply into the snow. That limits the rider's ability to angle the edge sharply into the snow surface, a prerequisite for what snowboarders refer to as "carving a turn." Any effort to make the mono-ski wider so this drag will not occur, either with the side-by-side or the fore-and-aft binding arrangements, is likely to cause a corresponding decrease in ability to weight the edges, with a resulting loss of control.

This problem is not peculiar to mono-skis. As recreational skiers become more skilled and aggressive, the inability of traditional skis to "carve" on hard snow surfaces is considered a serious deficiency. Various efforts, usually employing binding lifts, are being employed to allow skiers to bring their skis to a higher angle on edge without putting either boot or binding in the snow. The drawback is a higher center of gravity and less stability.

Snowboard

The failure of mono-skis to capture any significant share of the skiing market did not stop efforts to find a way to get lift-serve skiers off two sliding surfaces and onto a single board. Snowboards, which began as plastic backyard sliding devices, became more sophisticated and began to be accepted at a few mountains in the 1980s. The sport has exploded in popularity since then, in part because a snowboard allows the rider to apply heavy pressure to the working edge by shifting weight alternately to the heels and toes. Whether a snowboard rider uses "soft" snowboard boots or hard-shell racing boots, the bindings, like those of Alpine skis and mono-skis, lock down the heels. Heel lift on a snowboard is considered highly undesirable, since it would prevent the heel-side edge from rising on a toe-edge turn.

An early incarnation of the snowboard is revealed in Sep. 13, 1983, U.S. Pat. No. 4,403,785, issued to John M. Hottel. A more recent snowboard is described by Robert Katz in Nov. 13, 1990, U.S. Pat. No. 4,969,655.

In the Katz snowboard and similar versions, a solution is found to the mono-ski's persistent problem of inadequate edge pressure and resulting poor control on hard-packed snow. With bindings set up nearly perpendicular to the axis of the snowboard, the rider can alternately lean far forward and backward to drive the edge into a packed snow surface.

But that edging power comes with a cost—snowboards, typically nearly a foot in width to accommodate the rider's perpendicular stance, are much slower turning than skis. Their slow edge-to-edge, or heel-toe action, makes them hard to handle in moguls or "bumps" and in tight spaces. The sideways stance is also unnatural for skiers accustomed to facing forward, and makes the use of poles impractical. As a result, snowboarders spend a lot of time sitting on the snow, rather than standing, and arduously hopping up slight inclines, rather than easily poling up them.

OBJECTS AND ADVANTAGES

A More Stable, Faster Turning Skiboard

The principal object of creating the Nordic skiboard described in this application was to create a new type of mono-ski that would overcome the obstacles to success of previous efforts. The goal was to be accomplished by creating a board-binding system that would deliver a snowboard's power to carve hard-packed snow without the snowboard's slow turning speed. The new ski product draws on the best aspects of Alpine skiing, Nordic skiing, mono-skiing and snowboarding. It reconfigures elements of each one of these branches of the prior art and uses loose heel or Nordic bindings in a novel and non-obvious fashion—to anchor a skier, with feet acutely angled either right- or left-foot-forward, on a single board that must fall within certain definable dimensions. The result of this skiboard-binding combination, or system, is a surprisingly versatile new ski product that may justifiably be defined as a new snow sport.

Traditional mono-skis turn poorly on hard-packed or granular snow, in part because of the narrow stance they provide and in part became it is hard to apply enough weight to either edge. While there have been previous efforts to alter the narrow side-by-side stance of the traditional mono-ski with a fore-and-aft arrangement, those have also used Alpine binding system designed to accommodate inflexible Alpine boots. The length of the Alpine binding set-ups, combined with the narrow profile of a typical ski, made it necessary to keep the boots virtually aligned with the axis of the ski. That alignment, combined with the lock-down Alpine bindings, restricts the rider's movements and thereby limits weight shifts necessary to maintain balance and to pressure the ski's edges for hard, "carving" turns.

Applying edge pressure and bringing the ski far over on edge is done easily on the skiboard described in this application, which is technically a mono-ski but which has the snow-carving power of its cousin, the snowboard. Like a snowboard, and unlike other mono-skis, the bindings on the skiboard described herein are angled off the axis of the board, with the option of riding left- or right-foot-forward, according to the preference of the rider. Like a snowboard, and unlike a mono-ski, the angled stance made possible by use of compact Nordic bindings and the width of the skiboard described in this application keeps the feet of the rider over the deck of the board from toe to heel. As a result, the boots and bindings will not make contact with the snow unless the rider is so far over on edge that a fall has already occurred or is imminent. The board-binding system described in this application permits a "toe-edge" turn that puts the rider in the classic telemark position, a low, stable stance providing toe-edge pressure. The reverse, or heel-side turn, is more similar to the type of turn made by a snowboarder. It is accomplished by pushing off from the telemark position. That allows the rider to carve turns like a snowboarder, one of the most desirable features of the snowboard over other ski devices. But at the same time, the fast edge-to-edge action provided by the comparatively narrow width of the board and its steep sidecut lets the rider turn with the speed of the best skiers.

Typical mono-ski riders, their heels locked down in narrow stances in inflexible Alpine boots and bindings, cannot crouch far to lower their center of gravity when extra stability or speed is needed. In the side-by-side binding set-ups of typical mono-skis, the weight of the rider moves backward as the rider bends his or her knees to increase speed, eventually raising the front of the board and causing a loss of steering control. The skiboard described in this application, in combination with its loose-heel Nordic binding system, allows the rider to virtually drop the back knee onto the center of the deck of the board while placing the rider's weight on the balls of both feet, providing full weight along an entire edge along with an extremely low center of gravity and sharply reduced air resistance for speed and stability. The system also allows the rider to shift weight dramatically forward and backward in a way that is impossible with lock-down Alpine bindings, because the Nordic bindings allow both heels to rise and fall. That mobility allows faster turns than possible on snowboards or even most skis.

Turning Speed

The Nordic skiboard described in this application solves the principal deficiency of snowboards—slow turning speed due to width. That is accomplished through the combination of the skiboard's relatively narrow width and hour-glass shape with the use of two Nordic, or telemark, bindings. Those bindings are situated in acutely angled fore-and-aft positions on a single board when the two longitudinal halves of the divisible skiboard are combined, and at all times on the non-divisible skiboard embodiment. The relatively narrow skiboard described here, its width falling between that of a traditional Alpine ski and a free-carve snowboard, can be brought quickly from edge-to-edge.

The design width range of the skiboard is crucial to the success of this combination: If the board is too narrow, like that of a conventional ski, the binding cannot be angled sufficiently and the stance is unstable as a result. If the board is too wide, approaching that of even the narrowest snowboard, the heel lift provided by the Nordic bindings becomes a disadvantage, rather than an advantage. The disadvantage arises because the heel-side edge on a wider board will not rise if the Telemark bindings are angled so the toe and heel of the boots rest on their respective edges. Thus both the functional width of the board and the functional angles of the bindings are circumscribed within relatively narrow ranges described in this application.

Loose-Heel Bindings Enhance Control, Safety

The subject skiboard's Nordic binding arrangement offers a significant departure and improvement over previous efforts at a fore-and-aft mono-ski binding arrangement. The Evans et al Solo Ski binding patent document, referred to above, stresses the desirability of heel lock-down and allowing the rear heel lateral movement. That follows the prevailing wisdom of the ski industry. Ever since lift-served areas were created, t has been an article of ski faith that heel lock-own, first on independent skis, then on mono-skis and snowboards, is the key to control. The Nordic skiboard design is based on a new concept: that vertical heel lift on both feet, such as that provided by telemark bindings, is an advantage on a single skiboard of its dimensions, because the heel-lift permits extreme forward-backward weight shifts. At the same time, the skiboard described here does not permit the lateral foot movement promoted by the Evans Solo Ski binding system, in the belief that both vertical heel lift and lateral stability are both essential to a rider's control on a skiboard with fore-and aft binding arrangements.

Unlike previous and existing mono-skis, which feature releasable Alpine bindings, the skiboard described in this application employs non-release cable or telemark Nordic bindings. We believe that snowboard users have proven over the past decade that keeping both legs secured to a single board is the best way to prevent lower-body injury. The subject skiboard's Nordic binding system also allows the use of flexible Nordic boots, which permit the rider to bend the foot while raising the heel, and to weight the ball of the rear foot and the heel of the front foot to arc the board. This arrangement applies all the weight of the skier to the waist of the ski, making it easier to arc and turn than it would be with an Alpine binding arrangements. The flexibility of the telemark boots also makes them more comfortable to wear than typical hard-shell, inflexible Alpine ski boots.

The subject skiboard draws from the ancient roots of skiing—the loose-heel binding—to create a new, cutting edge snow sport. It employs a Nordic dual-ski binding system, with non-releasable, loose-heel bindings designed to accept a 75 mm or other Nordic telemark-style boot, in a new and unforeseen way. Mounted at acute angles on a single board of the subject skiboard's dimensional range, these simple, relatively primitive bindings are the key to a high-performance skiboard. The boots are readily available and may range from less-expensive flexible leather lace-ups to hard-shell types hinged at the instep, depending on the preference of the rider.

The Nordic skiboard was designed on the premise that heel-lift is necessary for optimum control and turning ability on a single board of its dimensions. The initial reaction of skiers and ski experts is invariably skepticism, until they either use the new skiboard themselves or see an accomplished rider demonstrate his or her skill.

The skiboard described in this application is thus a novel combination of aspects of many ski disciplines. It draws on the snowboarding concept of offset bindings for powerful edging, but reduces the angle of that offset so the rider is forward facing, rather than standing sideways on the board. The subject skiboard's narrow profile allows this more forward stance, and also permits much faster turns than possible on a snowboard while still providing a snowboard's ability to "carve." Because of this forward stance, a rider of the subject skiboard, unlike a snowboarder, can comfortably use poles.

The Nordic skiboard described here improves on the traditional mono-ski because its angled fore-and-aft foot setup allows heavy edge pressure. It offers a significant departure from previous fore-and-aft mono-ski setups, which rely on Alpine skis and on Alpine boots and bindings, because it relies on Nordic boots and bindings and the heel lift they provide, and because the specially designed skiboad's wider top surface allows acute angling of the bindings while eliminating the potential for binding or boot drag on the snow surface.

Binding Features

Both the Nordic skiboard invention which is divisible into skis, and one-piece, or lift-served, version offer convenient and unique binding set-up features. On the divisible skiboard, a binding base plate connects the binding toe and heel pieces and also serves as a brace used to connect the two longitudinal halves that serve as independent skis. A sliding connecting stud in the stem allows the binding system to be fixed either for use on the independent skis or for use in connecting the longitudinal halves, or skis, and riding the resulting skiboard. On the downhill, or one-piece, model, a 10-hole insert pattern, in which the inserts are arranged in two groups of five, allows Nordic Norm bindings to be rapidly installed and strongly fixed in place for either right-foot or left-foot forward riding.

The construction of the Nordic skiboard itself involves no novel materials or techniques. It can be made by virtually any method commonly used to make skis or snowboards.

DETAILED DESCRIPTION OF INVENTION

Figure 1:
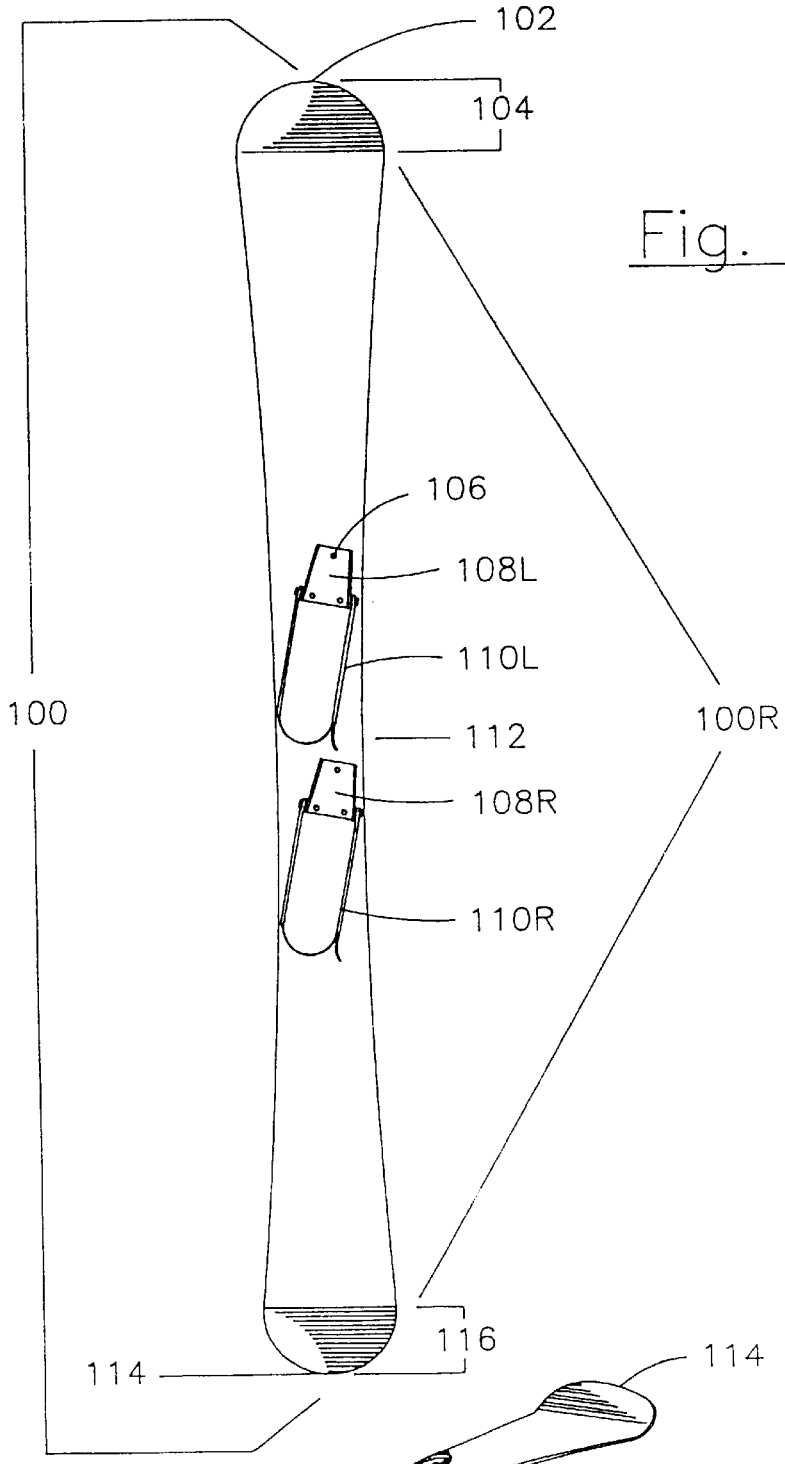
FIG. 1 shows a top view of the first embodiment of this skiboard invention, with standard Nordic Norm pinless cable telemark binding toe pieces aligned in a left-foot-forward arrangement.

The first embodiment of the invention is a single skiboard (FIGS. 1 and 2) that employs standard Nordic Norm telemark bindings (left binding illustrated in FIG. 15 by combination of a binding toe piece 108L and a heel cable 110L, and right binding by combination of a binding toe piece 108R and a heel cable 110R) or other loose-heel Nordic-style bindings, with binding toe pieces 108L and 108R set at acute angles to the axis of the ski one in front of the other. In this description the first embodiment of the skiboard is generally designated by reference numeral 100. This embodiment is intended primarily for use in lift-served ski areas.

Figure 13:
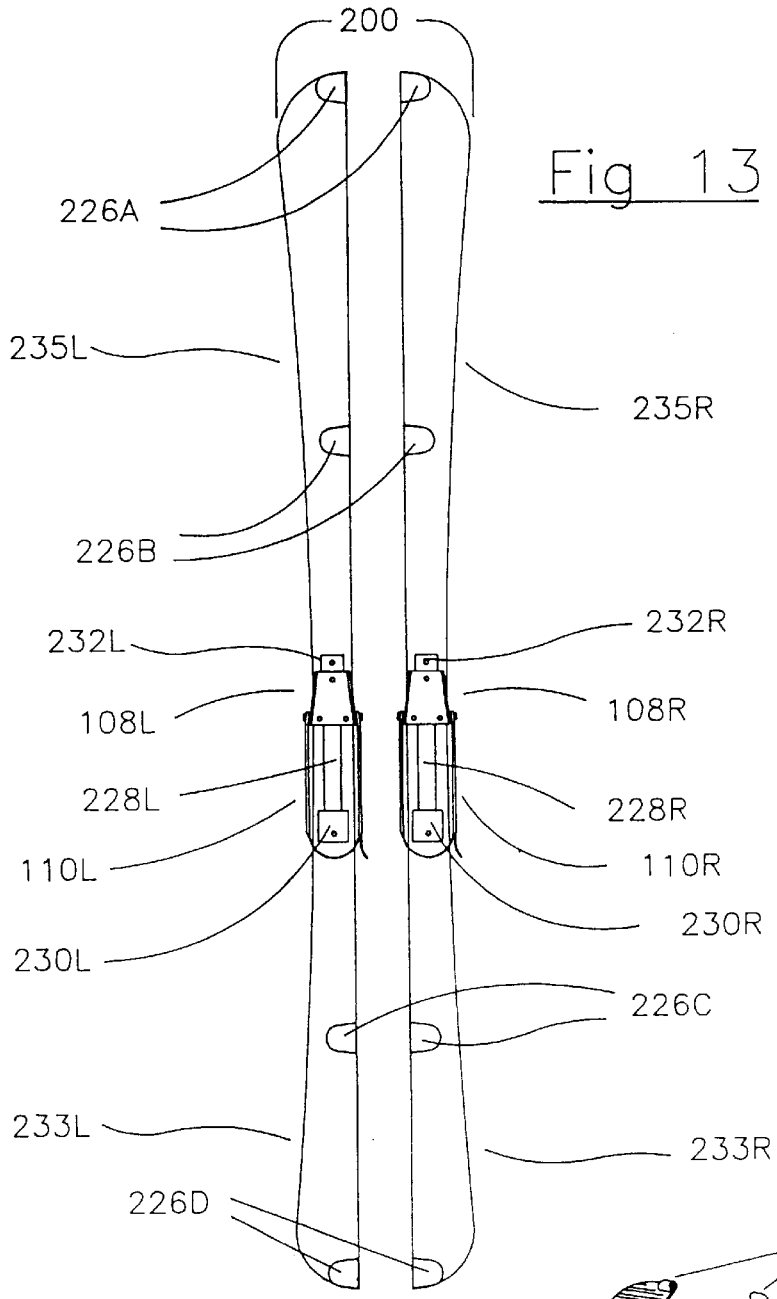
FIG. 13 is a top view of the second embodiment of the skiboard, showing it divided into its longitudinal halves and with binding assemblies fixed in place for the halves to be used as independent skis.
Figure 14:
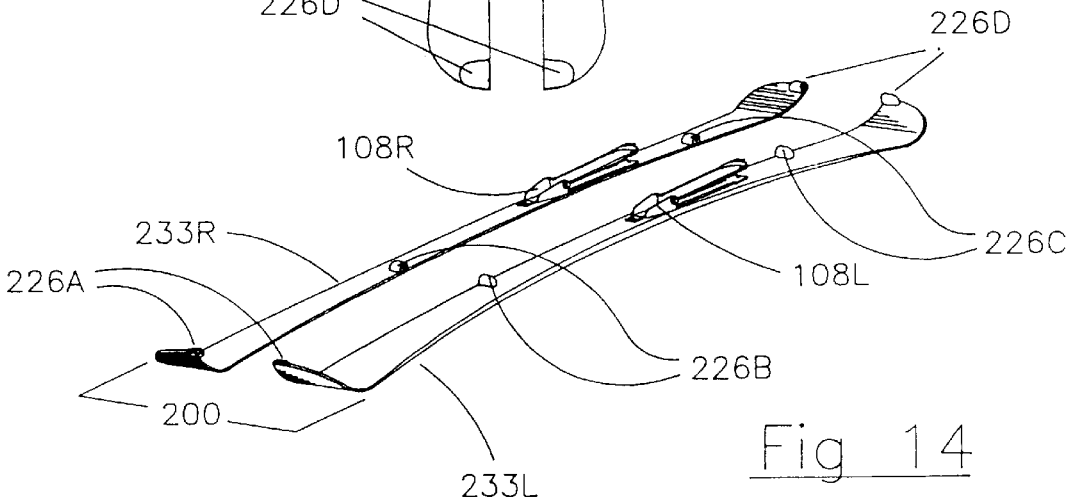
FIG. 14 is a perspective view of the second embodiment of the skiboard, showing it divided into its longitudinal halves and with binding assemblies fixed in place for the halves to be used as independent skis.

The second embodiment of the invention (FIGS. 11 and 12), is generally designated by the reference numeral 200. It is a skiboard of like dimensions to skiboard embodiment 100, and also uses multiple arrangements of Nordic bindings. The primary difference from skiboard embodiment 100 is that embodiment 200 can, when desired, be separated into longitudinal halves 233L and 233R for use as independent skis (FIGS. 13 and 14). It is intended primarily for back-country use, where the user may want to be able to move his legs independently to glide over flat areas and up hills but retain the option of linking halves 233L and 233R into a single embodiment 200 (FIGS. 11 and 12) for control on steep descents.

Figure 15:
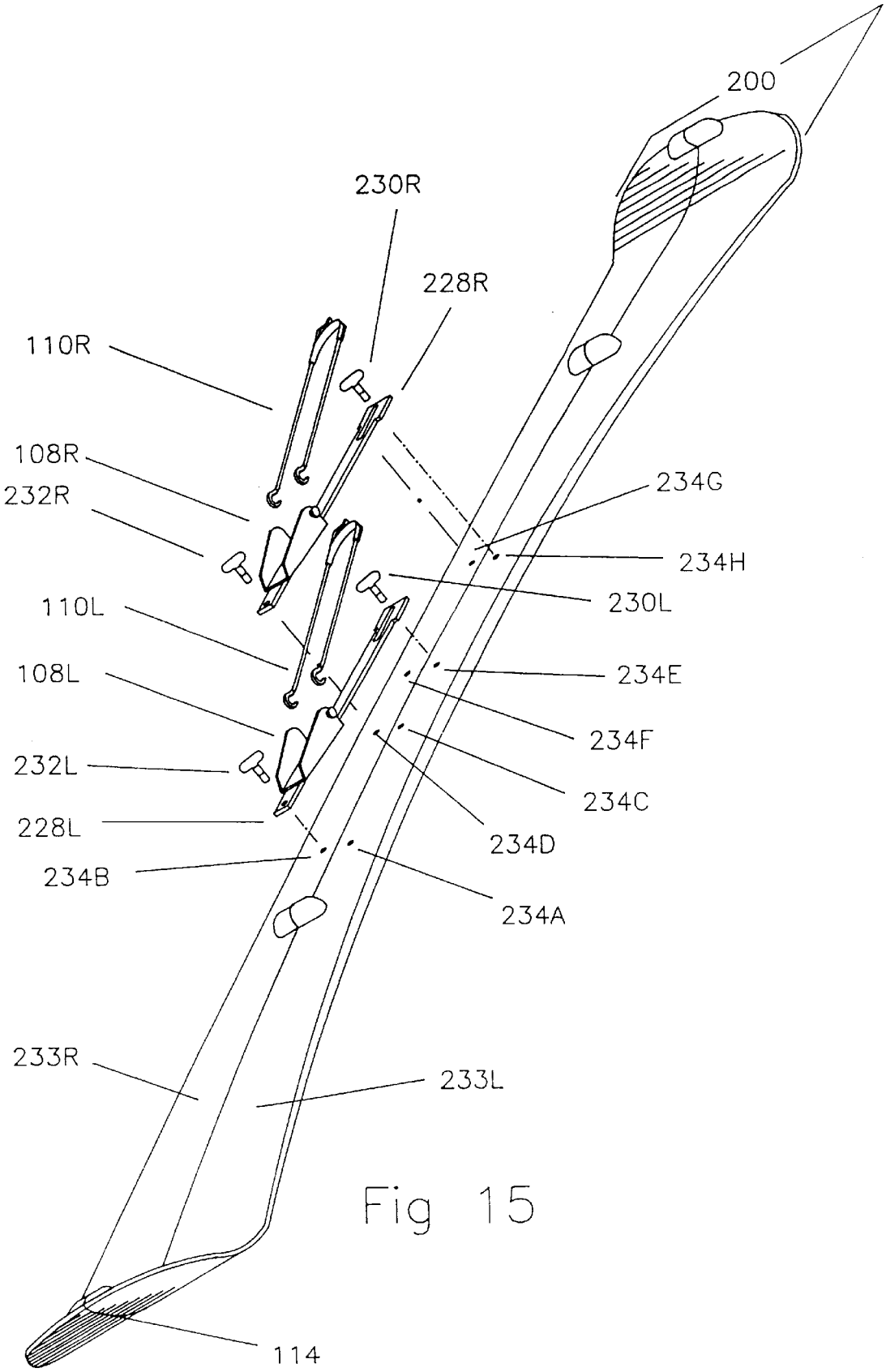
FIG. 15 is an explosion diagram showing how the binding assemblies would be installed for left-foot-forward riding when the longitudinal halves of the second embodiment of the skiboard are joined.
Figures 22, 23, 24, 25:
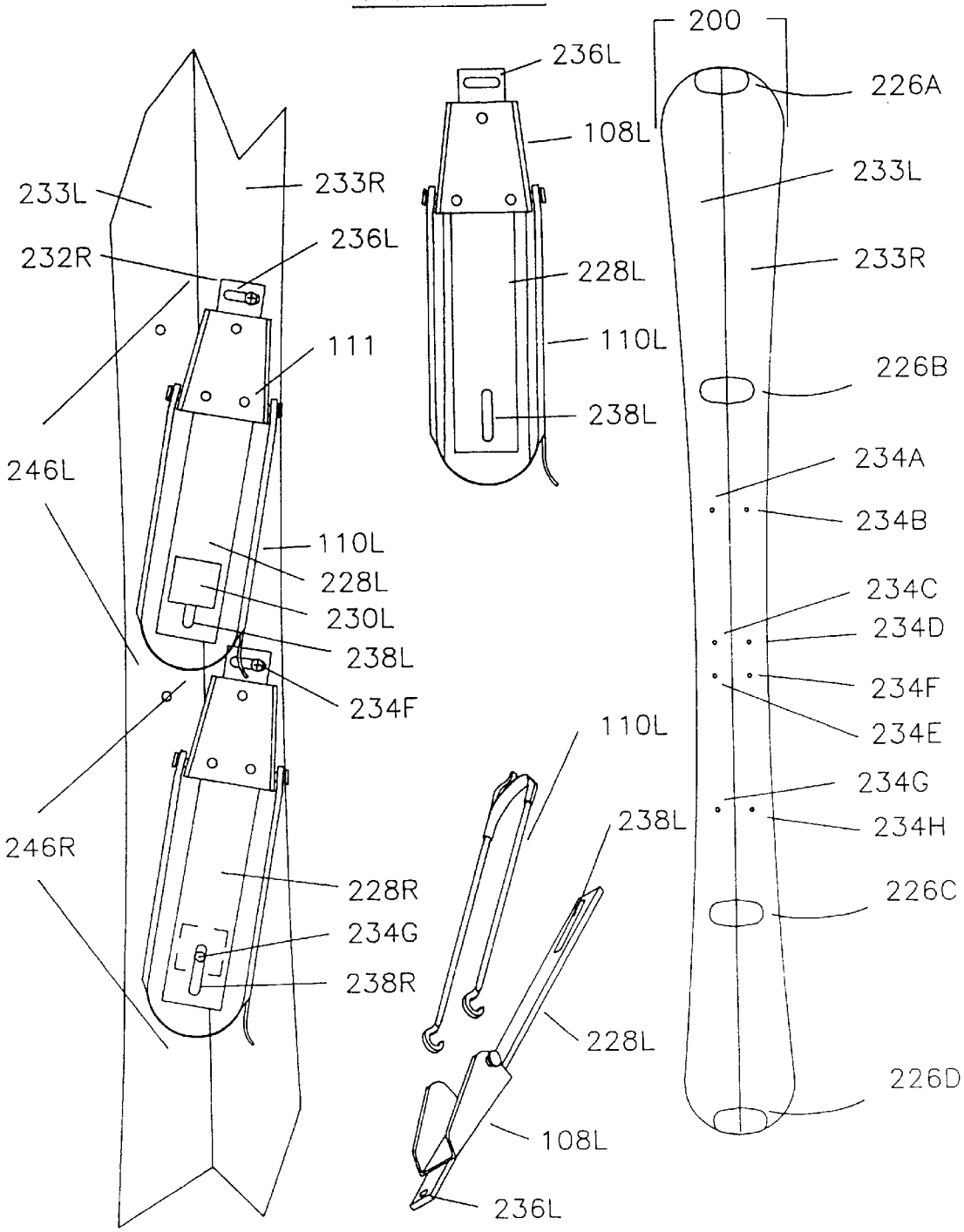
FIG. 22 is a top view of a fragment of the second embodiment of the skiboard, with the longitudinal halves joined by binding assemblies set for left-foot-forward riding.
FIG. 23 is a top view of the left-foot binding assembly used on the second embodiment of the skiboard.
FIG. 24 is a perspective view of the left-foot binding assembly used on the second embodiment of the skiboard.
FIG. 25 is a top view of the second embodiment of the skiboard, showing the relative location of insert holes or posts required to mount the binding assemblies for use either on the independent longitudinal halves or on the single skiboard. This view also shows preferred locations for latching devices that help bind the independent longitudinal halves together for use as a single skiboard.

Both skiboard embodiments 100 and 200 use standard Nordic Norm or other Nordic-style bindings, such as those in FIGS. 15, 23 and 24, designed for use with telemark boots (not shown). Both skiboard embodiments 100 and 200 may be constructed using a variety of standard ski construction methods well-known in the industry.

Because they do not lock down the rider's heels, we believe standard Nordic Norm or telemark bindings, such as those illustrated in FIGS. 15, 23 and 24, will only function well on a skiboard falling within the specific parameters set in this description. On a wider skiboard, the loose-heel aspect of Nordic bindings would cause control problems, and a narrower board would be too unstable.

Figure 11:
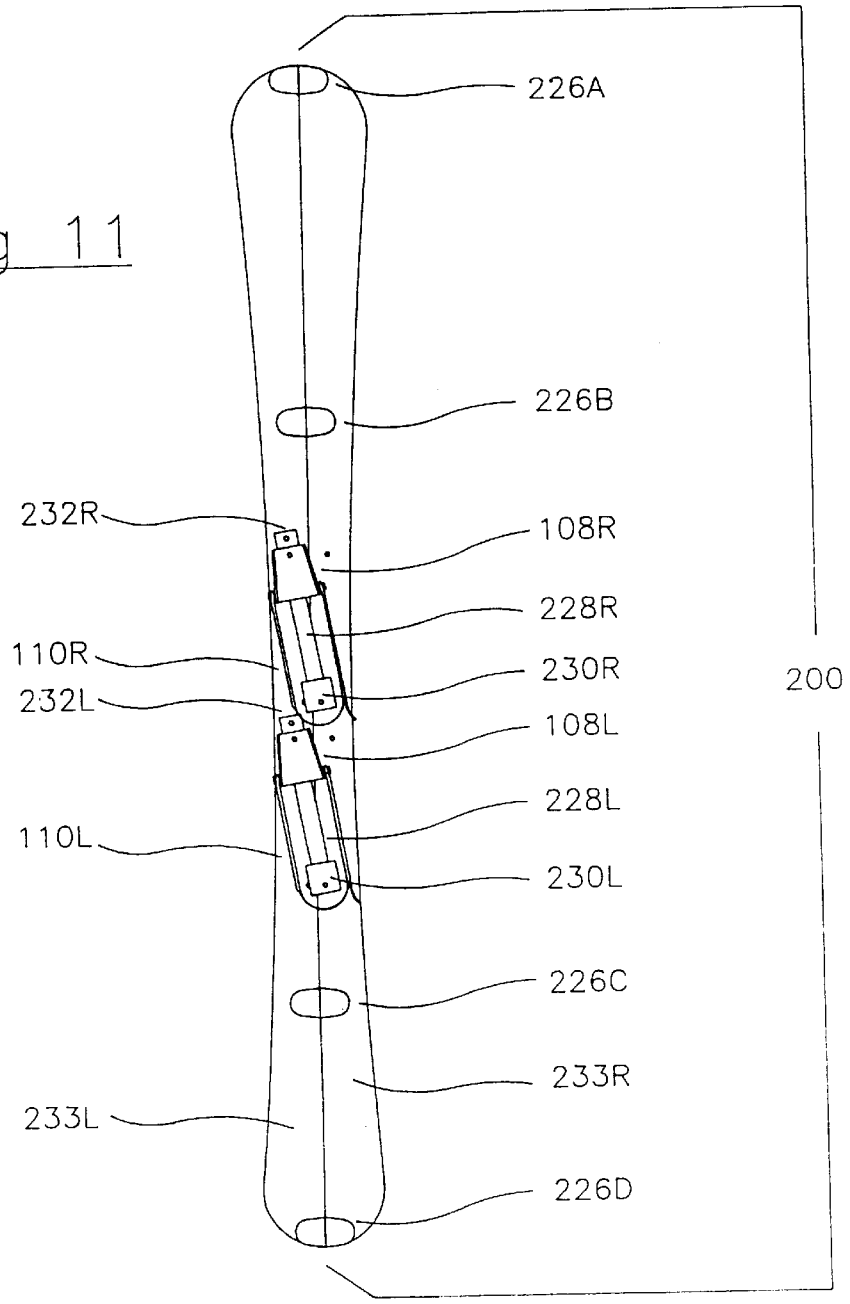
FIG. 11 is a top view of the second embodiment of the skiboard, with its independent longitudinal halves, or skis, joined by two binding-base plate assemblies and four other connectors or latches mounted on the surfaces of the longitudinal halves.

Referring to FIGS. 1 and 11, in skiboard embodiments 100 and 200 the maximum width of a front shovel area 104 and a rear shovel area 116 is 6 to 9 inches. A waist 112, or narrowest portion, on skiboard embodiment 100 and 200 falls 0 to 12 centimeters behind their longitudinal midpoints.

The sidecut radius on skiboard embodiments 100 and 200, designated by R in FIG. 1, may vary from an arc describing a section of a circle with a radius of 3 meters to an arc describing a circle with a radius of 20 meters.

The lengths of skiboard embodiments 100 and 200 may range from 150 to 200 centimeters.

Figure 3:
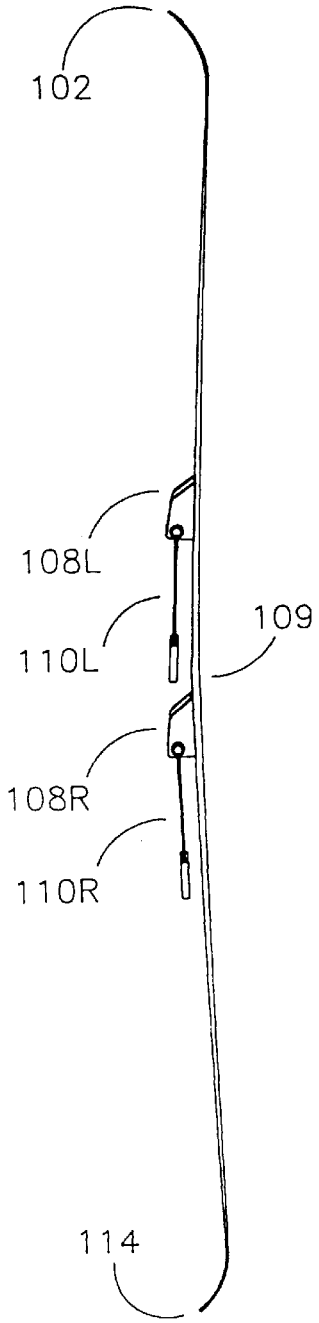
FIG. 3 is a right side view of the first embodiment of the skiboard.

Referring to FIG. 3, the maximum unweighted arch or camber 109 of skiboard embodiments 100 and 200, which is measured off a horizontal plane on which a skiboard rests (not shown), ranges from 1 to 6 centimeters.

Referring to FIG. 1, on both skiboard embodiments 100 and 200 a front shovel area 104 begins to rise 7 to 11 centimeter back toward waist 112 from an imaginary vertical line (not shown) that intersects a front tip 102 when either embodiment 100 or 200 is placed on a horizontal plane. Front tip 102 rises to a point 2 to 6 centimeters above that plane. Again referring to FIG. 1, a rear shovel area 116 begins to rise 6 to 9 centimeters back toward waist 112 from an imaginary vertical line (not shown) that intersects a rear tip 114 when either skiboard embodiments 100 or 200 is placed on a horizontal plane. Rear tip 114 rises to a point 1.5 to 5 centimeters above that plane.

Figure 4:
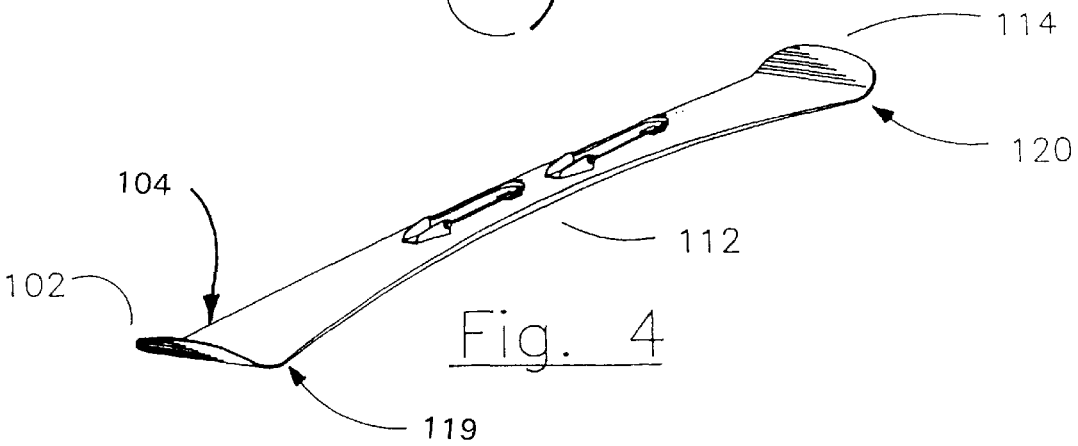
FIG. 4 is a perspective view of the first embodiment of the skiboard.

Referring to FIG. 4, the thicknesses of skiboard embodiments 100 and 200 reach a maximum of 1 to 2.5 centimeters at waist 112 and, progressing toward tip 102, the thickness tapers progressively to between 0.5 and 1.5 centimeters at point 122, where front shovel area 104 (FIG. 1) begins to rise. From that point to tip 102, the thickness tapers progressively to between 0.25 and 1 centimeter. A similar taper occurs from waist 112 to rear tip 114. Additional thickness in the rear of waist 114—up to 30 percent more than that allowed in front of waist 114—is desirable for skiboards that will be used at high speeds. Overall thickness will affect stiffness, with softer skiboards more desirable for mogul skiing and stiffer skiboards preferable for speed.

Figure 19:
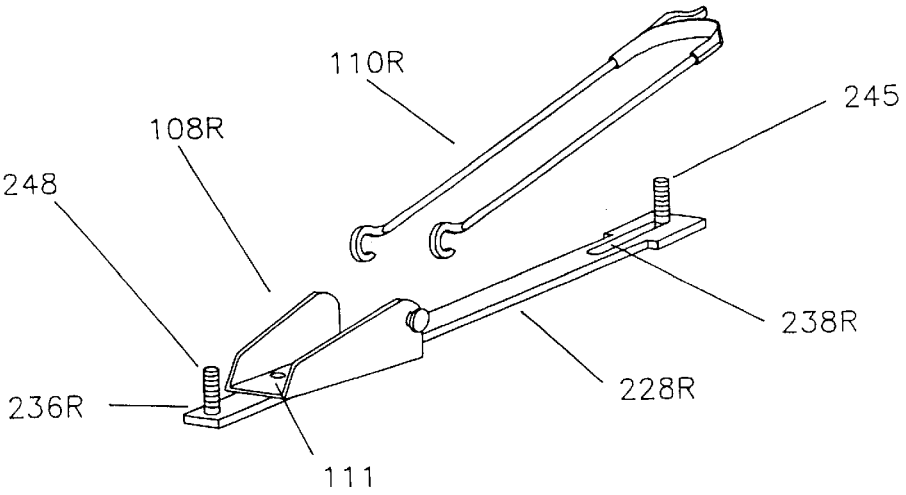
FIG. 19 shows how two threaded posts would protrude through binding base plate slots when the binding base plate is ready to be tightened into place on the second embodiment of the skiboard.

Referring to FIG. 19, each of the two standard Nordic Norm or telemark binding toe pieces 108R and 108L to be used on skiboard embodiment 200 are mounted permanently by rivets or fasteners 111 to base plates 228R and 228L. Binding base plates 228R and 228L may be made of 0.25 to 0.5 centimeter rolled steel or aluminum in 4- to 8-centimeter widths, or other materials of dimensions that provide similar strength.

Figure 12:
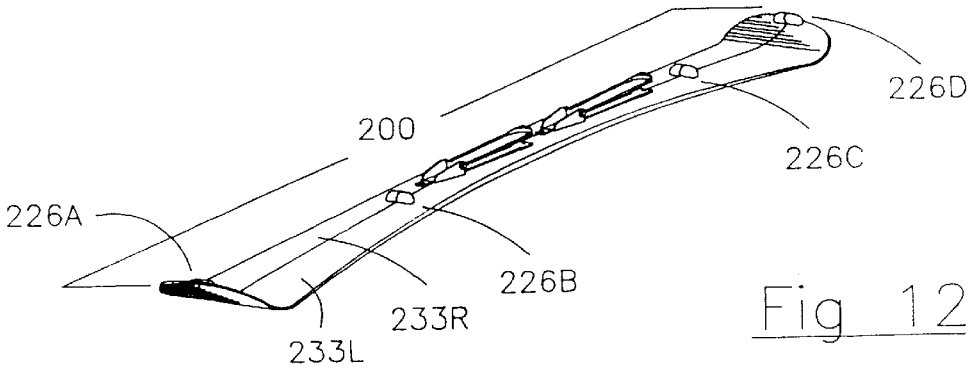
FIG. 12 shows a perspective view of the second embodiment of the skiboard, with its longitudinal halves connected, as it would appear ready for use as a single skiboard.

Referring to FIG. 15, binding base plates 228R and 228L serve to help connect skiboard halve 233R and 233L when they are combined for use as single skiboard 200 (also shown in FIGS. 11 and 12). Referring to FIG. 22, a preferred embodiment of binding assembly 246L includes toe piece 108L bound to binding base plate 238L by three rivets or fasteners 111, with heel cable 110L attached to binding toe piece 108L. Near the rear of binding base plate 228L is a longitudinal slot 238L that is 1 to 10 centimeters in length and 0.25 to 1 centimeter in width. In front of binding toe piece 108L, binding base plate 238L has a latitudinal slot that measures 1 centimeter to 5 centimeters in length and 0.25 to 1 centimeter in width. In one preferred embodiment (FIG. 22 ), longitudinal slot 238L is penetrated by a threaded bolt 230L with an elongated or square head which serves as a heel pad for the riders boot (not shown). The elongated head of bolt 230L also allows the user to hand tighten it as a connector to any of several combinations of threaded t-nuts or other receivers 234A–H (FIG. 25) installed in the surface of skiboard embodiment 200.

There are many potential methods for connecting binding assemblies 246R and 246L in a variety of positions to the surface of skiboard embodiment 200. In the preferred embodiment illustrated in FIG. 17, latitudinal slot 236R (FIG. 19) is penetrated by a threaded wing nut 232R. Wing-nut 232R may be hand-tightened by the user to connect the front of binding assembly 246R (FIG. 22) to several combinations of threaded t-nuts or receivers 234A–H installed in the surface of the board (FIG. 25).

Referring to FIGS. 1 and 11, in preferred versions of skiboard embodiments 100 and 200 the binding toe pieces 108R and 108L are mounted at acute, nearly parallel angles ranging from 1 to 35 degrees off either side of the axis of the skiboard. The objective is to locate binding toe pieces 108R and 108L and the heels of the rider (not shown) as close as possible to the opposing edges of skiboards 100 and 200 without either of the binding toe pieces or the heels of the rider overlapping any edge more than 2 centimeters.

Referring to FIG. 1, in skiboard embodiments 100 and 200 the binding toe pieces 108R and 108L should be mounted so the narrowest portion of the skiboard, waist 112, falls between the heel of the front ski boot (not shown) and whichever binding toe piece is placed in the rear. When locked in binding toe piece 108L or 108R, the heel of the front boot (not shown) should fall 0 to 12 centimeters in front of an imaginary line drawn perpendicular to the axis of skiboard embodiments 100 or 200 at waist 112. When locked in binding toe piece 108R or 108L, the toe of the rear boot should lie 0 to 12 centimeters to the rear of waist 112. This binding arrangement allows a rider (not shown) to pressure waist 112 and thus arc either skiboard embodiment 100 or 200 properly in turns.

Figure 6:
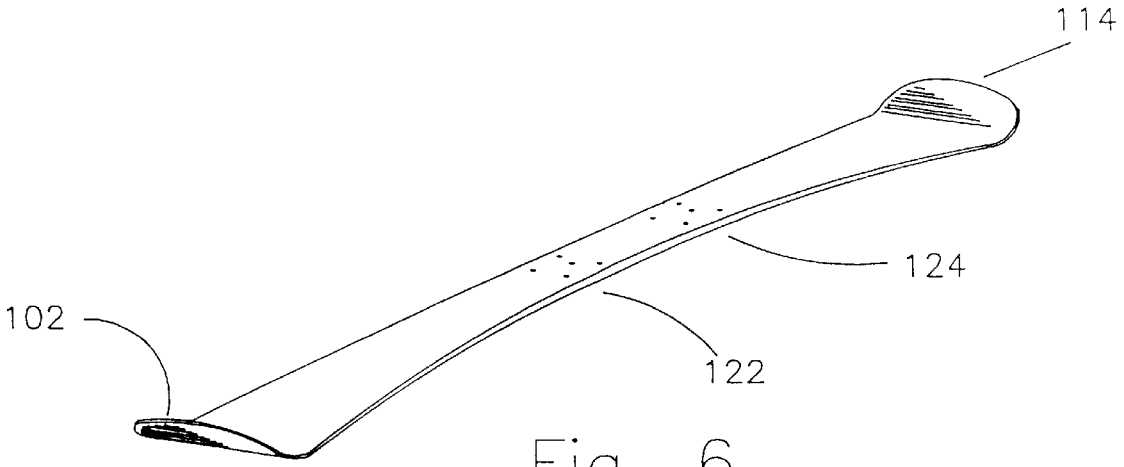
FIG. 6 is a perspective view of the first embodiment of the skiboard without bindings.
Figure 7:
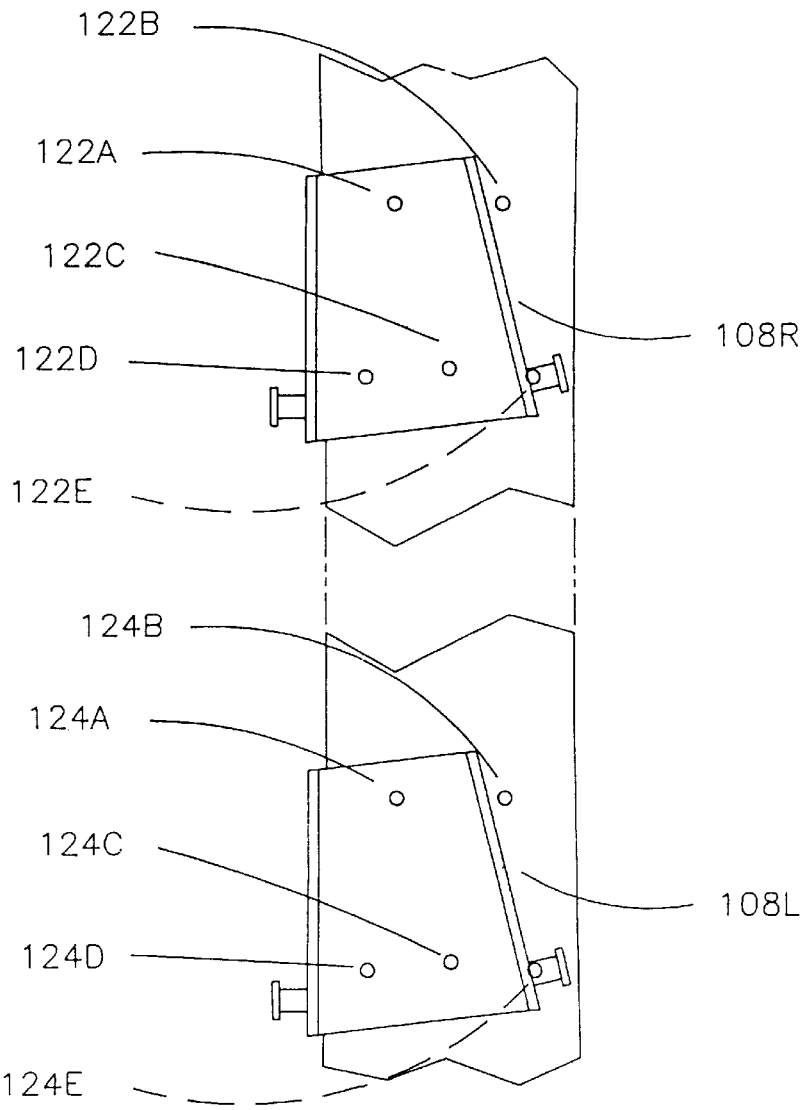
FIG. 7 shows a fragmented top view of the center of the first embodiment of the skiboard with an outline of binding toes pieces aligned in a right-foot-forward arrangement over the threaded inserts used to connect them to the skiboard.
Figure 9:
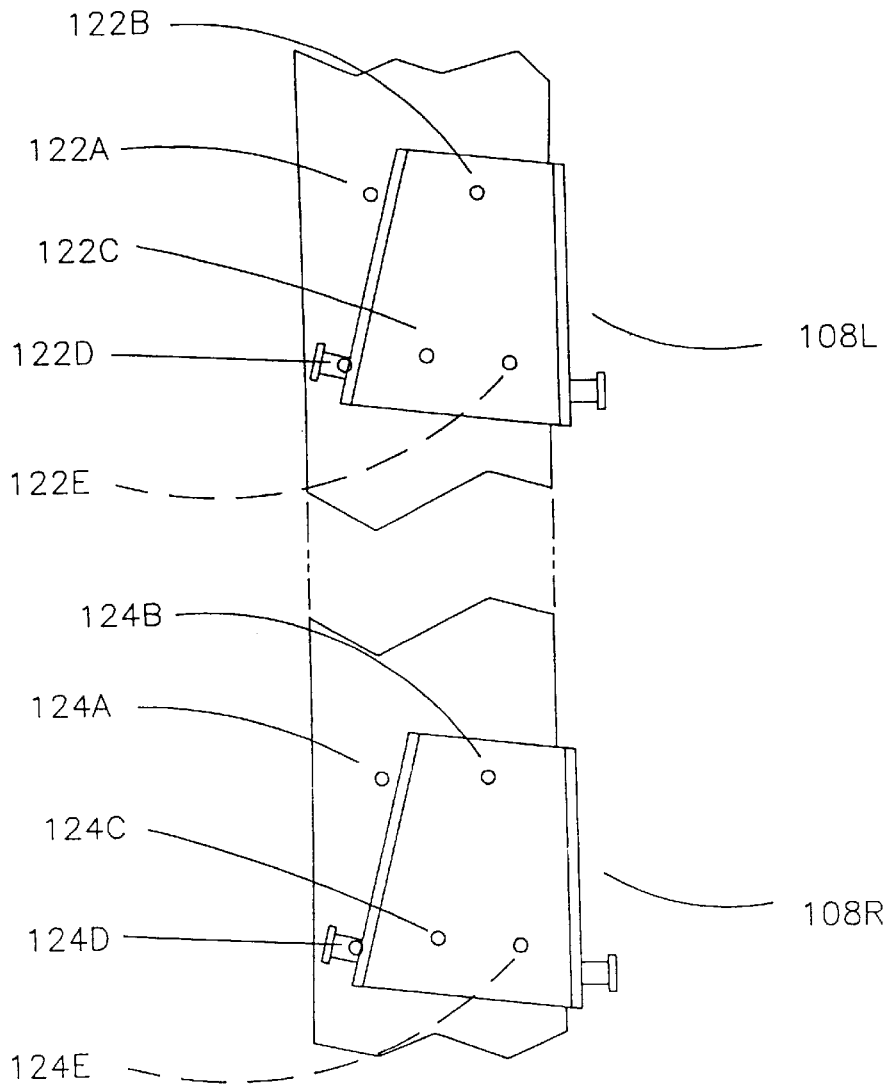
FIG. 9 is a fragmented top view of the center of the first skiboard embodiment, with an outline of binding toe pieces aligned in a left-foot-forward arrangement over the inserts used to connect them to the skiboard.

Referring to FIG. 6, on skiboard embodiment 100 threaded inserts or threaded t-nuts (represented in FIG. 17 at 240) are installed in a wood core (represented in FIG. 17 at 242) two five-hole patterns. The insert installation patterns shown in FIG. 6 allow typical three-hole Nordic Norm bindings to be quickly and securely attached with machine screws, bolts or other connectors (not shown) in either a right-foot-forward (FIG. 7) or left-foot-forward (FIG. 9) arrangement, depending on individual preferences. Referring to FIGS. 7 and 9, the front and rear insert patterns each have one of five threaded inserts, 122C and 124C, that can be used as one of the three anchor points required to attach the standard Nordic Norm toe piece in either the right-foot-forward (FIG. 7) or left-foot-forward (FIG. 9) fashion. This common hole eliminates the need to drill a structure-weakening sixth hole (not shown).

Referring to FIG. 7, the combination of inserts used for a right-foot-forward Nordic Norm binding toe piece arrangement is 122A, 122D and 122C for front binding toe piece 108R attachment and 124A, 124D and 124C for rear binding toe piece 108L attachment. Referring to FIG. 9, the combination of inserts used for a left-foot-forward Nordic Norm binding toe piece arrangement is 122B, 122C and 122E for the front binding toe piece 108L attachment and 124D, 124C and 124E for the rear binding toe piece 108R attachment.

Figure 16:
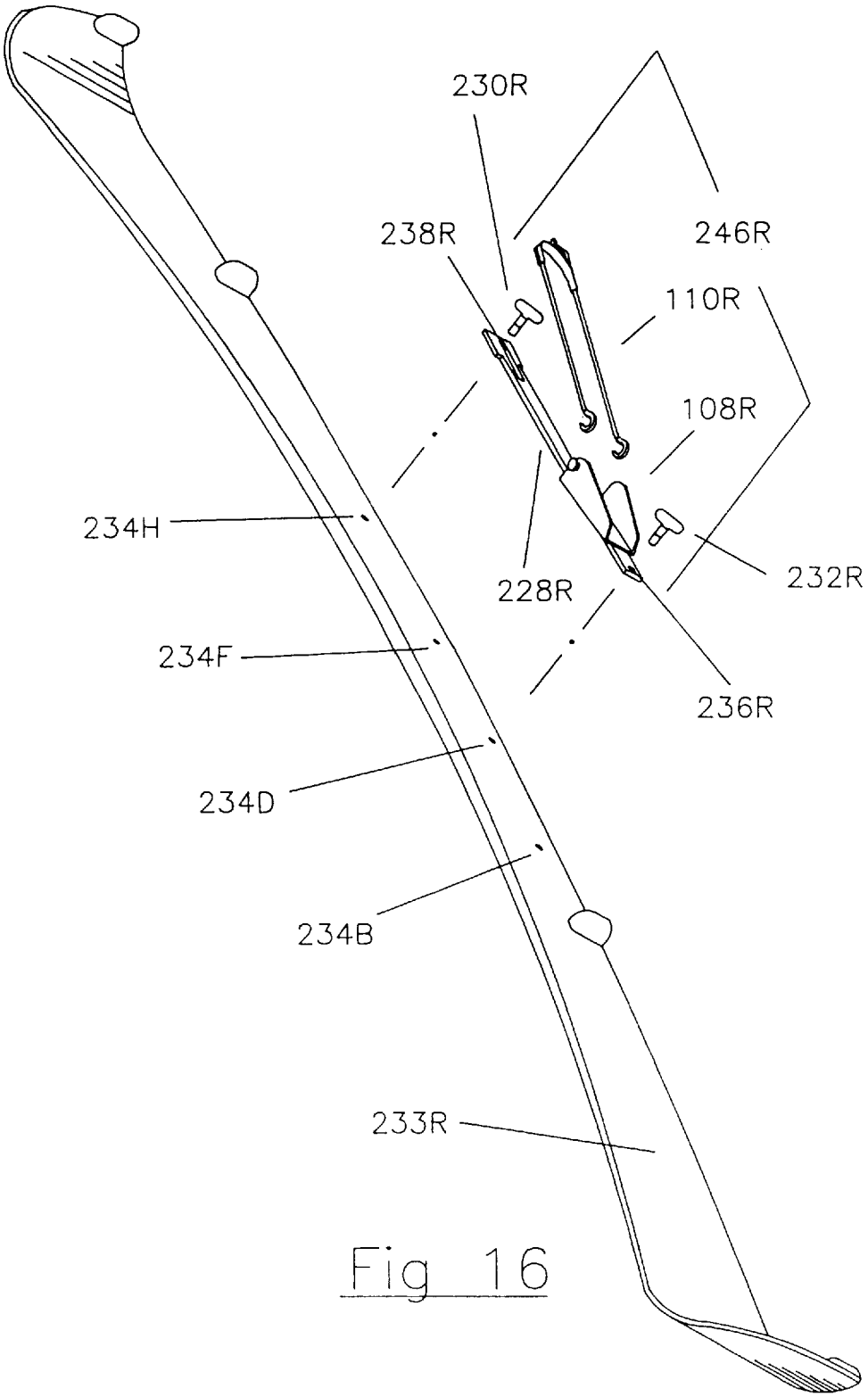
FIG. 16 is an explosion diagram of the right half, or ski, of the second embodiment of the skiboard, showing the right binding assembly as it might be installed for use on an independent ski.

Referring to FIG. 16, on one preferred embodiment of skiboard 200 binding assembly 246R is mounted for use on an independent ski, longitudinal half 233R, as follows: the front of binding assembly 246R is locked down by a 1 centimeter diameter hardened machine screw, wing-nut bolt or fastener 232R, which penetrates slot 236R and threads into t-nut 234D installed in the core (242 at FIG. 17) of longitudinal half 233R. The rear of binding assembly 246R is locked down similarly by machine screw or threaded wing-nut bolt 230R, which penetrates slot 238R and threads into t-nut 234H installed in the core of longitudinal half 233R. Referring to FIG. 25, left binding assembly 246L is attached to longitudinal half 233L in identical fashion but using t-nut locations 234C and 234G.

Referring to FIG. 15, when longitudinal halves 233R and 233L are connected for use as single skiboard 200 by a left-foot-forward rider, binding assembly 246L (also shown as a group of elements in FIG. 22) is mounted in the proper position by locking connector 232L down onto receiver 234B and by locking connector 230L down onto receiver 234E. Binding assembly 246R (shown as a group of elements in FIG. 22) is mounted in the proper position by locking connector 232R down onto receiver 234D and by locking connector 230R down onto receiver 234G. The right-foot-forward binding arrangement is accomplished in similar fashion, with binding assembly 246R being mounted in the forward position onto receivers 234A and 234D and binding assembly 246L being mounted onto receivers 234E and 234H.

The binding lock-down system described above for skiboard embodiment 200 may employ several variations. One preferred embodiment (FIG. 18) employs a plurality of posts 245 that protrude from the surface of the board and which fit through binding base plate slots 236R and L and 238R and L to position them where needed. In that embodiment, a threaded wing nut 248 and a threaded nut with an elongated head (as represented in 230L, FIG. 22) would be used to lock down binding assemblies 246R and 246L.

On skiboard embodiment 200 (FIG. 11), each of toe pieces, 108R and 108L, and their respective base plates, 228R and 228L, are connected permanently by three rivets or fasteners 111 and are moveable as binding assemblies 246 and 246L (detailed in FIGS. 15 and 22). Base plates 228R and 228L must be of suitably strong material such as 0.5 centimeter by 4 centimeter plates of aluminum or stainless steel, because they are placed under stress when used as devices for connecting longitudinal halves 233R and 233L, as shown in FIG 11.

Figure 20:
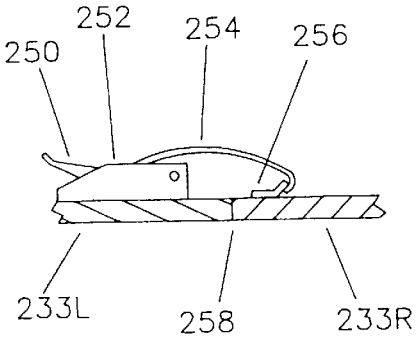
FIG. 20 is a cutaway side view of how a standard, heavy-duty, over-center draw latch could be used to help connect the longitudinal halves of the second embodiment of the skiboard.
Figure 21:
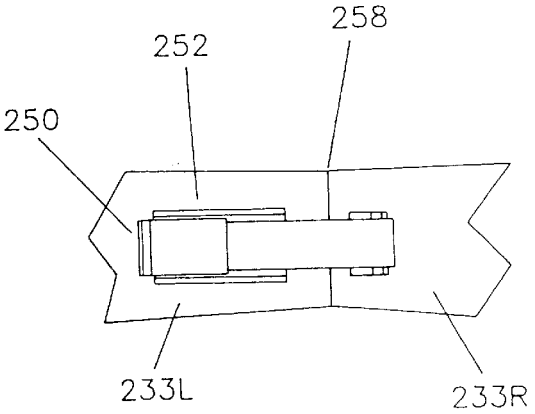
FIG. 21 is a top view showing how a standard, heavy-duty, over-enter draw latch might be used to help connect the longitudinal halves of the second embodiment of the skiboard.

Referring again to FIG. 11, skiboard embodiment 200 is joined by binding assemblies 246R and 246L and a plurality of other connectors or latches 226A–D (also shown in FIG. 25) mounted on the surfaces of skiboard embodiment 200. A variety of latches may be used, one prefer embodiment (FIG. 20) employing a stainless steel over-center draw latch. Referring to FIGS. 20 and 21, the latch body 252 is installed on the surface of longitudinal half 233L and keeper 256 is installed on the opposing surface of longitudinal half 233R. Latch arm 254 is extended to engage keeper 256 and then drawn down by depressing lever 250, thereby eliminating the intervening gap 258. The latches used should have a draw strength of at least 50 pounds to withstand the stresses of using the skiboard.

Skiboard embodiments 100 and 200 are may be constructed by virtually any of the methods common to the ski and snowboard manufacturing industry. A preferred embodiment involves a vertically laminated hardwood core sandwiched between layers of epoxy-soaked triaxial fiberglass fabric. The topsheet may be chemically treated polyamide material and the base material of extruded or sintered polyethlene with chemically etched surfaces to help adhesion of inks or epoxy. Standard steel ski edges should wrap all exposed edges of the base material. All requisite hardware may be fabricated easily by those skilled in the art or purchased from existing source of supply.

Conclusion, Ramifications, Scope of Invention

The invention skiboard introduces a new winter sport. In its basic form, the skiboard is a device that allows the user in a lift-served ski area to carve hard, fast turns with the power of a snowboard and the speed of traditional downhill skis. In its divisible embodiment, it allows the user to penetrate remote back-country regions on independent cross-country style skis, which can be joined, using the same bindings, into a skiboard for control on steep downhill runs.

While the description above contains many specificities, these should not be construed as limitations on the scope of the invention, but rather as an exemplification of one preferred embodiment thereof. For example, the invention skiboard may use any loose-heel binding devices, such as 75 millimeter, three-pin telemark bindings with or without heel straps or cables, 75-millimeter cross-country ski bindings, step-in bindings that allow the heel of the boot to rise, NNN BC type telemark bindings, or strap devices designed to hold down the toe and instep of the rider while leaving the heel unfixed. The non-visible embodiment of the subject skiboard may also be employed for back country use by fixing one foot in the front binding toe piece and the other on an auxiliary snow shoe.

Also, a wide variety of latches or connectors may be used to bind together the longitudinal halves, or skis, of the divisible embodiment of the skiboard. In addition to the over-center draw latches discussed in the description of invention section of this patent application and illustrated in the accompanying drawings, flexible rubber draw latches, bolt-action latches, a wide variety of slam-action or other latches, or straps may be used, in a variety of positions and numbers.

The devices used to connect the binding assemblies to the skiboard embodiments may include, in addition to those discussed above and shown in the accompanying drawings, any type of compact fastener or flat latching device designed to hold down the binding or binding assembly. Examples include quarter-turn fasteners, captive screws and cam locks.

Accordingly, the scope of the invention should be determined not by the embodiments illustrated but by the appended claims and their legal equivalents.

What is claimed is:

1. A skiboard comprising, in combination, a central portion of said skiboard, front and rear ends of said central portion being between 15 and 23 centimeters in width, said central portion having side edges and a central waist, said side edges having concave curvatures of a radius between 3 and 20 meters, said side edges extending between said front and rear ends of said central portion so that said concave curvatures of said side edges form said central waist, an upward curving front shovel area having a front tip and being formed by the front end of said central portion, said front shovel area curving upward from said central portion 7 to 11 centimeters behind said front tip so that said front tip is raised at least 2 centimeters, said skiboard being between 150 and 200 centimeters in length, said skiboard central portion having a longitudinal camber, said camber elevating said waist between 1 and 6 centimeters, left and right loose-heel binding devices having at least a toe portion and a front end of said toe portion, and means securing said binding devices to said central portion substantially parallel to each other and with one of said binding devices in front of said waist and one of said binding devices behind said waist, said skiboard having a longitudinal axis, said means releaseably and alternately securing said binding devices so that said binding devices are angled to the right of said axis when said left binding device is in front of said right binding device and said binding devices are angled to the left of said axis when said right binding device is secured in front of said left binding device at an acute angle less than 35 degrees from said axis.

2. The combination according to claim 1 with the addition of an upward curving rear shovel area having a rear tip and being formed at the rear of said central portion, said rear shovel area curving upward from said central portion between 6 and 9 centimeters from said rear tip so that said rear tip is raised at least 1.5 centimeters.

3. The combination according to claim 2 with the addition of three fastening means associated with each of said binding devices allowing removal and re-attachment of said binding devices, said fastening means having co-acting elements fixed to said binding devices and to said central portion of said skiboard, one of said co-acting elements of said fastening means for each of said binding devices being at said front end of said toe piece and two of said co-acting elements of said fastening means for each of said binding devices being spaced apart behind said front end of said toe piece, said co-acting elements of said fastening means being fixed to said central portion of said skiboard alternately securing each of said binding devices at an acute angle to the right and to the left of said longitudinal axis of said skiboard.

4. The combination according to claim 2 wherein said co-acting elements of said fastening means fixed to said central portion of said skiboard are in clusters of five to secure each of said binding devices, each of said clusters having two forwardly disposed spaced apart co-acting elements to selectively receive the co-acting element at the front end of one of said toe pieces, and each of said clusters having three rearwardly disposed co-acting elements, said three co-acting elements having a center co-acting element and outwardly disposed co-acting elements disposed to each side thereof, said two spaced apart co-acting elements for each of said binding devices engaging said center co-acting element of said rearwardly disposed co-acting elements fixed to said central portion and one of said outwardly disposed co-acting elements fixed to said central portion.

5. A skiboard system comprising, a skiboard and left and right loose heel binding secured to said skiboard, said skiboard having:

a longitudinal axis;

a central portion having side edges and a central waist, said side edges having concave curvatures of radius, said side edges extending between front and rear ends of said central portion so that said concave curvatures of said side edges form said central waist, said central portion further having a longitudinal camber, said camber elevating said waist; and an upward curving front shovel area having a front tip and being formed by the front end of said central portion, and wherein said left and right loose heel bindings are secured to said central portion substantially parallel to each other on opposite sides of said waist at an acute angle less than 35 degrees from said longitudinal axis and wherein said bindings are angled to the right of said longitudinal axis when said left binding is in front of said waist and said bindings are angled to the left of said longitudinal axis when said right binding is secured in front of said waist.

* * * * *

UNITED STATES PATENT AND TRADEMARK OFFICE

CERTIFICATE OF CORRECTION

PATENT NO. : 5,816,590
DATED : October 6, 1998
INVENTOR(S) : Martin J. Fey et al.

It is certified that error appears in the above-identified patent and that said Letters Patent is hereby corrected as shown below:

Delete entire specification Columns 1 - 13, lines 1 - 29 and substitute the attached specification Columns 1 - 13, lines 1 - 26, as shown on the attached pages.

Signed and Sealed this

Tenth Day of September, 2002

*Attest:*

*Attesting Officer*

JAMES E. ROGAN
*Director of the United States Patent and Trademark Office*

NORDIC SKIBOARD

CROSS REFERENCE TO RELATED APPLICATIONS

The filing date of this application relies upon provisional application No. 60/015,419, filed in the U.S. Patent and Trademark Office on Apr. 15, 1996.

FIELD OF INVENTION

This invention creates a new snow sport, Nordic skiboarding. The Nordic skiboard described here is relatively narrow, light-weight and extremely maneuverable. It employs two Nordic or telemark bindings fixed in fore-and-aft positions at relatively parallel acute angles on a single board. Nordic skiboarding combines elements of snowboarding, Alpine Skiing, Nordic Skiing and mono-skiing.

BACKGROUND OF THE INVENTION

Skiing began centuries ago in Scandinavia as a way to travel on foot over snow. It was largely unknown in other parts of Europe until it was introduced in the Alps as a novelty in the latter half of the 1800s. At that time, skis were primarily used for gliding over relatively flat terrain, and in fact were sometimes referred to as "Norwegian snowshoes." Their length—up to 12 feet or longer—made them virtually impossible to turn on steep downhill runs.

As skis became more recreational than utilitarian, they were made shorter and became more manageable. It became possible to execute downhill turns on them using a technique developed in the village of Telemark, Norway. This technique, which became known as the telemark turn, required dropping one knee and extending the other leg forward at an angle in the direction of the turn. The bindings, usually simply a leather strap that crossed the toe of the boot, allowed the heel to rise off the board. This had three functions: it allowed the skier to get up on the ball of the foot to execute the knee dip required for the telemark turn; it allowed enough movement to reduce the likelihood of leg injury in the event of a fall; and it allowed the skier to "walk" on the skis, like snowshoes, over flat areas and up hills.

Loose-heel bindings—now called Nordic or telemark bindings—were the rule in the early days of downhill skiing, in part because skiing required hiking up the mountain before gliding down it. In the 1930s, the first rope tows were installed in the U.S. and the new stem christy, or "wedge turn", supplanted the graceful, but more difficult, telemark turn. With no need to walk up hills or to dip a knee to turn, there was no longer a need to keep the skier's heel free. The releasable, lock-down binding appeared, and boots became stiffer and higher until hard-shell plastic models became the rule in the 1970s. Telemarking and loose-heel skiing went into eclipse.

In recent years, there has been a resurgence in telemark skiing. Improvements in boots, combined with an appreciation for the weight-shifting advantages of loose-heel bindings in soft snow, have made telemarking a fast-growing sport. Despite the relative difficulty of the technique—or perhaps in part because of it—telemark skiers have become a common sight even at lift-served areas.

Ironically, while ski lifts obviated the need for "walking" on skis, and thus nearly eliminated the loose-heel or Nordic binding from the ski scene, there was no effort to get away from having an independent ski on each foot until the 1960s. In that decade, several permutations of the mono-ski appeared, like that of Jacques Marchand, May 11, 1961, U.S.

Pat. No. 3,154,312, in which the bindings were set side-by-side. The intent was to put the skier in the approximate position he or she would be in if wearing two skis that were held tightly parallel.

This arrangement presents a serious problem, however. The side-by-side binding set-up, using traditional Alpine ski boots and lock-down, releasable bindings, does not permit the skier to apply weight heavily to either edge. This is especially significant because the total length of edge on a typical mono-ski is short, and is half what it would be on dual skis of the same length. While such mono-skis function adequately in soft snow conditions, they have failed to capture an appreciable share of the ski market because control on hard-packed snow or ice is very difficult with the side-by-side binding configuration. The mono-ski of Kent Hunter, Feb. 26, 1991, U.S. Pat. No. 4,995,631, discloses an attempt to deal with this problem by adding severe sidecut, or arcs, to the sides of a mono-ski; however, the stance remains side-by-side, which prevents the skier from putting full weight on the operational edge. In addition, the lock-down Alpine bindings on the Hunter ski and similar mono-skis, combined with the narrow stance, make falls likely even with temporary losses of balance, because the rider cannot shift weight through a wide forward-backward range.

Efforts were made over the years to create various mono-skis by linking pairs of conventional Alpine skis using various connecting devices. W. J. Wightman, Apr. 29, 1963, U.S. Pat. No. 3,171,667, offers a ski attachment for connecting a pair of skis and for maintaining the skis close together and parallel as a training aid. Alec Pederson, in Jun. 30, 1981, U.S. Pat. No. 4,275,904, discloses an attachment consisting of a tailbridge connector and a front plate for converting a pair of skis to a "twinski." Fritz Barthel et al, in Sep. 3, 1996 U.S. Pat. No. 5,551,728, describes a "gliding board" device that converts two Alpine skis into a wide mono ski or snowboard by attaching the skis on the sides of a full-length center piece.

The common denominator of the Wightman and Pederson connection systems, which are designed to convert two skis into a mono-ski, is that they place the skier's feet in a side-by-side stance. As a result, these divisible mono-ski incarnations present the same edging problem as the solid mono-skis. Barthel makes no suggestions as to how to locate the bindings, or even what type to use, and the large center piece would be impractical to carry in many situations; e.g. when a skier in the back country wants to convert two skis to a single board for control on deep powder or poor snow conditions. The Wightman, Pederson and Barthel systems also involve cumbersome connecting devices that would have to be removed while dual skiing to prevent snags on snow or brush.

There are documented efforts to create a mono-ski from a single conventional Alpine ski, with one foot placed ahead of the other. Those employ lock-down Alpine-type bindings set up to accommodate Alpine-type boots.

The "Stic Main"of Erich Genuit, described in Oct. 16, 1931, Deutsches Reich Patent 535818, and the Solo Ski binding system of Robert M. Evans and Franklin G. Miller, described in May 9, 1995 U.S. Pat. No. 5,413,373, offer various methods of converting one ski of a conventional pair into a mono-ski with fore-and-aft binding placement. Typical Alpine bindings and boots are employed in both descriptions, and neither Genuit nor Evans suggest offsetting the bindings at an angle to the axis to the ski. The illustrations in the both patent documents show the bindings in line with the axis of the ski. Traditional Alpine skis are too narrow to permit any significant offset of conventional Alpine bindings, even if it were considered desirable by the designers, because of the length of such binding arrangements, which typically include both a long toe piece and a bulky heel lock-down device.

As stated above, traditional mono-skis have been largely unsuccessful because the rider cannot deliver enough pressure on the edges to execute hard, rapid turns, particularly on hard-packed snow. Genuit's Stic Main and Evans' Solo Ski binding system do not solve this persistent problem, which is compounded by the fact that those systems try to adapt one ski of a downhill ski pair for use as a mono-ski, rather than designing a board for use in conjunction with their fore-and-aft binding arrangements.

The Genuit system includes beveled cuts in the ski that raise the arch side of each foot in relation to the outside of the same foot. Whether this arrangement would actually deliver more power to the edges is unlikely and difficult to ascertain, since there does not appear to be any ski on the market today that employs such a concept. Canting the boots outward in such a fashion would have clear disadvantages, however, making it difficult to bring the knees together in a mutually supporting fashion and making an already narrow and unnatural stance even more unstable, particularly while standing still on the slope.

The Evans Solo Ski binding system is also arranged along the axis of the ski. The front binding is described as a conventional, releasable Alpine ski binding. The rear binding, designed by Evans et al, also accommodates a conventional Alpine ski boot, but in a complex releasable binding that allows both vertical and lateral movement within a rubber cup, similar to the rubber bindings used on water skis. That lateral movement would be a disadvantage, creating instability and reduce the control of a rider attempting a hard, carving turn. Furthermore, the heel of the front foot is fixed in line with the ski, eliminating any possibility of lifting that heel for forward weight shifts and not allowing the application of extra toe or heel pressure on either edge with that foot. The Solo Ski binding system is designed for use on one ski of a conventional ski pair, and for conventional Alpine ski boots. The inflexible, hard-shell boots would not allow the rider to weight the balls of the feet, preventing the rider from accomplishing the dramatic forward-backward weight shifts necessary to adequately control such a long, narrow mono-ski. The lateral movement permitted by the rear binding would reduce control on fast, hard turns.

The use of releasable Alpine bindings on a mono-ski with fore-and-aft bindings also presents a safety problem. If only the front binding releases during a fall, the leg remaining connected to the rear binding may be subject to unusually strong twisting forces from the long end of the ski.

The traditional mono-ski and the existing fore-and-aft mono-skis also present the problem of boot overlap—that is, the boots and bindings will hang over the edge of the ski. As a result, both boot and binding will drag if the ski is angled sharply into the snow. That limits the rider's ability to angle the edge sharply into the snow surface, a prerequisite for what snowboarders refer to as "carving a turn." Any effort to make the mono-ski wider so this drag will not occur, either with the side-by-side or the fore-and-aft binding arrangements, is likely to cause a corresponding decrease in ability to weight the edges, with a resulting loss of control.

This problem is not peculiar to mono-skis. As recreational skiers become more skilled and aggressive, the inability of traditional skis to "carve" on hard snow surfaces is considered a serious deficiency. Various efforts, usually employing binding lifts, are being employed to allow skiers to bring their skis to a higher angle on edge without putting either boot or binding in the snow. The drawback is a higher center of gravity and less stability.

The failure of mono-skis to capture any significant share of the skiing market did not stop efforts to find a way to get lift-served skiers off two sliding surfaces and onto a single board. Snowboards, which began as plastic backyard sliding devices, became more sophisticated and began to be accepted at a few mountains in the 1980s. The sport has exploded in popularity since then, in part because a snowboard allows the rider to apply heavy pressure to the working edge by shifting weight alternately to the heels and toes. Whether a snowboard rider uses "soft" snowboard boots or hard-shell racing boots, the bindings, like those of Alpine skis and monoskis, lock down the heels. Heel lift on a snowboard is considered highly undesirable, since it would prevent the heel-side edge from rising on a toe-edge turn.

An early incarnation of the snowboard is revealed in Sep. 13, 1983, U.S. Pat. No. 4,403, 785, issued to John M. Hottel. A more recent snowboard is described by Robert Katz in Nov. 13, 1990, U.S. Pat. No. 4,969,655.

In the Katz snowboard and similar versions, a solution is found to the mono-ski's persistent problem of inadequate edge pressure and resulting poor control on hard-packed snow. With bindings set up nearly perpendicular to the axis of the snowboard, the rider can alternately lean far forward and backward to drive the edge into a packed snow surface.

But that edging power comes with a cost—snowboards, typically nearly a foot in width to accommodate the rider's perpendicular stance, are much slower turning than skis. Their slow edge-to-edge, or heel-toe action, makes them hard to handle in moguls or "bumps" and in tight spaces. The sideways stance is also unnatural for skiers accustomed to facing forward, and makes the use of poles impractical. As a result, snowboarders spend a lot of time sitting on the snow, rather than standing, and arduously hopping up slight inclines, rather than easily poling up them.

SUMMARY OF THE INVENTION

The problems associated with prior art ski and snowboard systems are overcome with the disclosed skiboard system. The system includes a skiboard and left and right loose heel binding. The skiboard has a central portion and an upward curving front shovel area. The central portion has a waist, which is the narrowest portion of the skiboard. The left and right loose heel bindings are secured to the central portion of the skiboard substantially parallel to each other on opposite sides of the waist at an acute angle less than 35 degrees from the longitudinal axis. Furthermore, the bindings are angled to the right of the longitudinal axis when the left binding is in front of the waist and the bindings are angled to the left of the longitudinal axis when said right binding is secured in front of the waist.

BRIEF DESCRIPTION OF DRAWINGS

Figure 2:
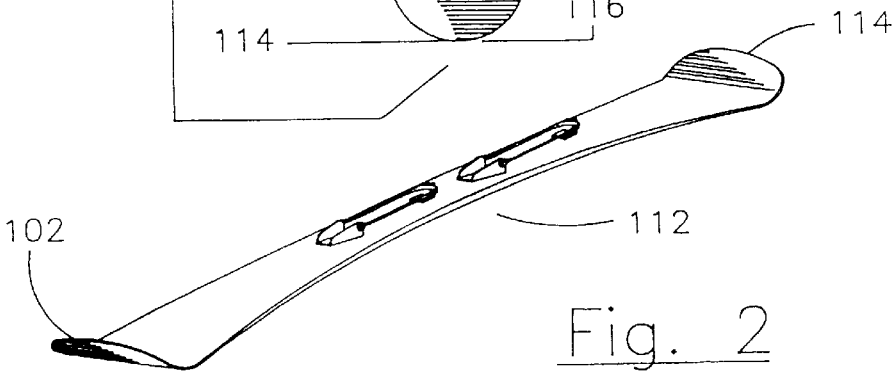
FIG. 2 is a perspective view of the first embodiment of the skiboard.
Figure 5:
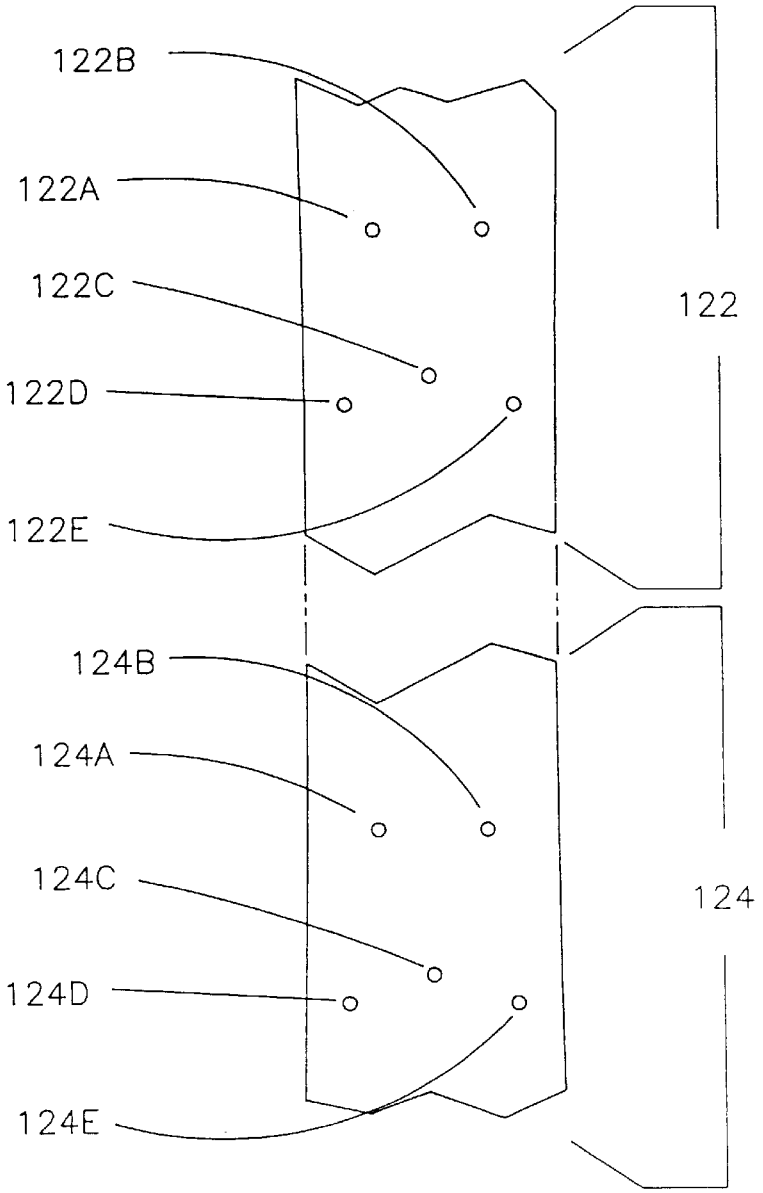
FIG. 5 is a fragmented top view of the center portion of the first embodiment of the skiboard, showing the two 5-insert patterns used to attach binding toe pieces in either a right- or left-foot-forward arrangement.
Figure 8:
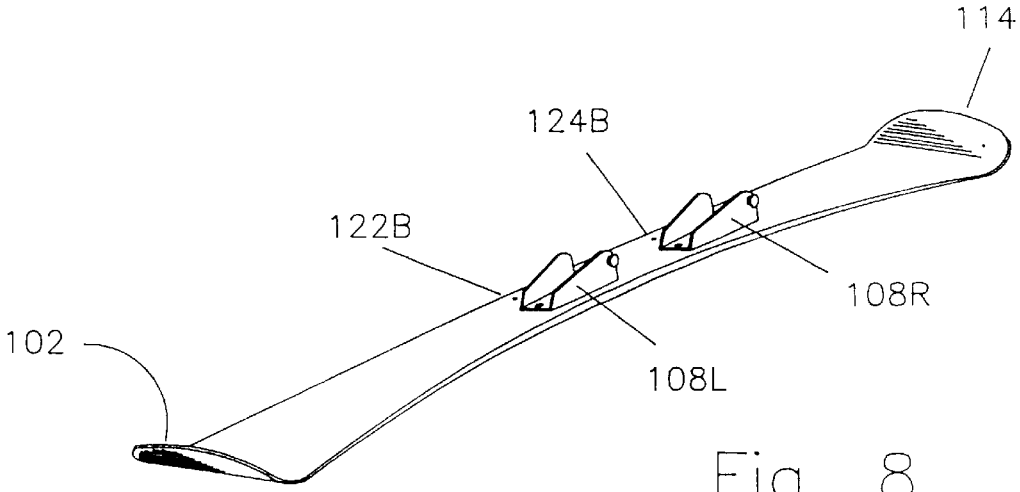
FIG. 8 is a perspective view of the first embodiment of the skiboard with binding toe pieces aligned in a right-foot-forward arrangement.
Figure 10:
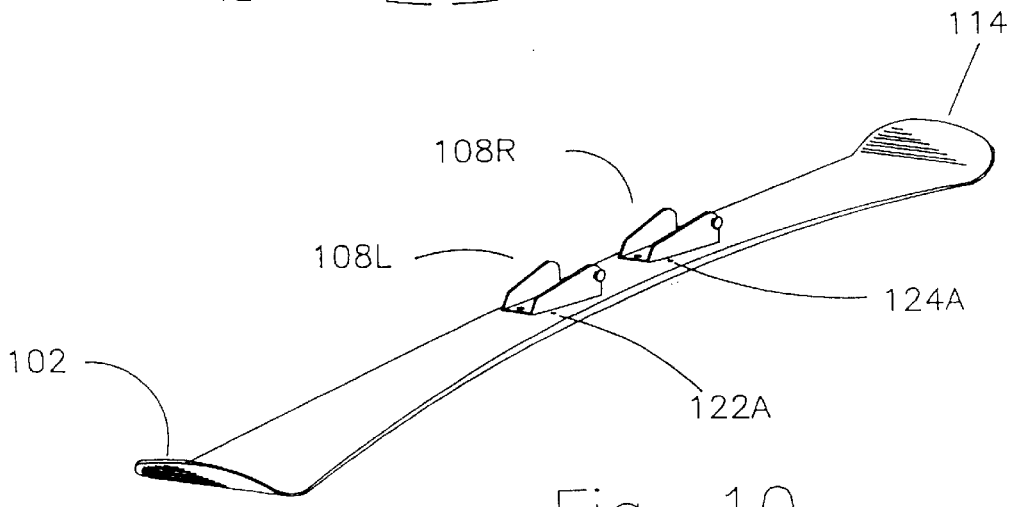
FIG. 10 is a perspective view of the first embodiment of the skiboard, with binding pieces aligned in a left-foot-forward arrangement.

FIG. 1 shows a top view of the first embodiment of this skiboard invention, with standard Nordic Norm pinless cable telemark binding toe pieces aligned in a left-foot-forward arrangement;

FIG. 2 is a perspective view of the first embodiment of the skiboard;

FIG. 3 is a right side view of the first embodiment of the skiboard;

FIG. 4 is a perspective view of the first embodiment of the skiboard;

FIG. 5 is a fragmented top view of the center portion of the first embodiment of the skiboard, showing the two 5-insert patterns used to attach binding toe pieces in either a right- or left-foot-forward arrangement;

FIG. 6 is a perspective view of the first embodiment of the skiboard without bindings;

FIG. 7 shows a fragmented top view of the center of the first embodiment of the skiboard with an outline of binding toes pieces aligned in a right-foot-forward arrangement over the threaded inserts used to connect them to the skiboard;

FIG. 8 is a perspective view of the first embodiment of the skiboard with binding toe pieces aligned in a right-foot-forward arrangement;

FIG. 9 is a fragmented top view of the center of the first skiboard embodiment, with an outline of binding toe pieces aligned in a left-foot-forward arrangement over the inserts used to connect them to the skiboard;

FIG. 10 is a perspective view of the first embodiment of the skiboard, with binding pieces aligned in a left-foot-forward arrangement;

FIG. 11 is a top view of the second embodiment of the skiboard, with its independent longitudinal halves, or skis, joined by two binding-base plate assemblies and four other connectors or latches mounted on the surfaces of the longitudinal halves;

FIG. 12 shows a perspective view of the second embodiment of the skiboard, with its longitudinal halves connected, as it would appear ready for use as a single skiboard;

FIG. 13 is a top view of the second embodiment of the skiboard, showing it divided into its longitudinal halves and with binding assemblies fixed in place for the halves to be used as independent skis;

FIG. 14 is a perspective view of the second embodiment of the skiboard, showing it divided into its longitudinal halves and with binding assemblies fixed in place for the halves to be used as independent skis.

Figure 17:
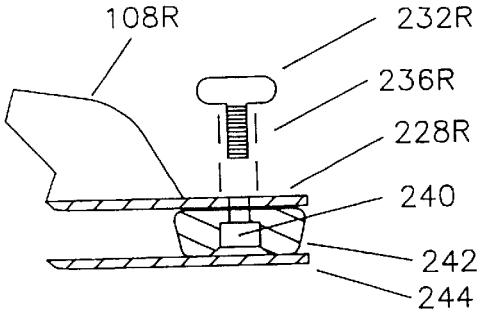
FIG. 17 shows one option for attaching the front end of a binding base plate to the second embodiment of the skiboard, by tightening a wing-nut bolt into a t-nut installed in the skiboard core.
Figure 18:
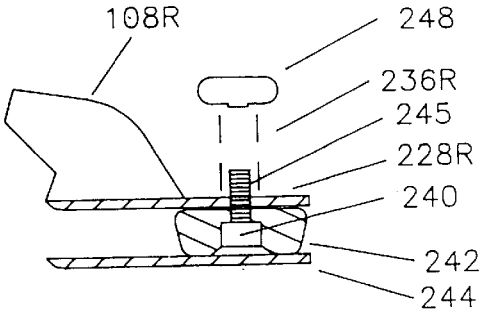
FIG. 18 shows a second option for attaching the front end of a binding base plate to the second embodiment of the skiboard, by locking a threaded post into a t-nut and tightening a wing-nut over that threaded post.

FIG. 15 is an explosion diagram showing how the binding assemblies would be installed for left-foot-forward riding when the longitudinal halves of the second embodiment of the skiboard are joined;

FIG. 16 is an explosion diagram of the right half, or ski, of the second embodiment of the skiboard, showing the right binding assembly as it might be installed for use on an independent ski;

FIG. 17 shows one option for attaching the front end of a binding base plate to the second embodiment of the skiboard, by tightening a wing-nut bolt into a t-nut installed in the skiboard core;

FIG. 18 shows a second option for attaching the front end of a binding base plate to the second embodiment of the skiboard, by locking a threaded post into a t-nut and tightening a wing-nut over that threaded post.

FIG. 19 shows how two threaded posts would protrude through binding base plate slots when the binding base plate is ready to be tightened into place on the second embodiment of the skiboard;

FIG. 20 is a cutaway side view of how a standard, heavy-duty, over-center draw latch could be used to help connect the longitudinal halves of the second embodiment of the skiboard;

FIG. 21 is a top view showing how a standard, heavy-duty, over-center draw latch might be used to help connect the longitudinal halves of the second embodiment of the skiboard;

FIG. 22 is a top view of a fragment of the second embodiment of the skiboard, with the longitudinal halves joined by binding assemblies set for left-foot-forward riding.

FIG. 23 is a top view of the left-foot binding assembly used on the second embodiment of the skiboard;

FIG. 24 is a perspective view of the left-foot binding assembly used on the second embodiment of the skiboard;

FIG. 25 is a top view of the second embodiment of the skiboard, showing the relative location of insert holes or posts required to mount the binding assemblies for use either on the independent longitudinal halves or on the single skiboard. This view also shows preferred locations for latching devices that help bind the independent longitudinal halves together for use as a single skiboard.

DETAILED DESCRIPTION OF INVENTION

The principal object of creating the Nordic skiboard described in this application was to create a new type of mono-ski that would overcome the obstacles to success of previous efforts. The goal was to be accomplished by creating a board-binding system that would deliver a snowboard's power to carve hard-packed snow without the snowboard's slow turning speed. The new ski product draws on the best aspects of Alpine skiing, Nordic skiing, mono-skiing and snowboarding. It reconfigures elements of each one of these branches of the prior art and uses loose heel or Nordic bindings in a novel and non-obvious fashion—to anchor a skier, with feet acutely angled either right- or left-foot-forward, on a single board that must fall within certain definable dimensions. The result of this skiboard-binding combination, or system, is a surprisingly versatile new ski product that may justifiably be defined as a new snow sport.

Traditional mono-skis turn poorly on hard-packed or granular snow, in part because of the narrow stance they provide and in part because it is hard to apply enough weight to either edge. While there have been previous efforts to alter the narrow side-by-side stance of the traditional mono-ski with a fore-and-aft arrangement, those have also used Alpine binding systems designed to accommodate inflexible Alpine boots. The length of the Alpine binding set-ups, combined with the narrow profile of a typical ski, made it necessary to keep the boots virtually aligned with the axis of the ski. That alignment, combined with the lock-down Alpine bindings, restricts the rider's movements and thereby limits weight shifts necessary to maintain balance and to pressure the ski's edges for hard, "carving" turns.

Applying edge pressure and bringing the ski far over on edge is done easily on the skiboard described in this application, which is technically a mono-ski but which has the snow-carving power of its cousin, the snowboard. Like a snowboard, and unlike other mono-skis, the bindings on the skiboard described herein are angled off the axis of the board, with the option of riding left- or right-foot-forward, according to the preference of the rider. Like a snowboard, and unlike a mono-ski, the angled stance made possible by use of compact Nordic bindings and the width of the skiboard described in this application keeps the feet of the rider over the deck of the board from toe to heel. As a result, the boots and bindings will not make contact with the snow unless the rider is so far over on edge that a fall has already occurred or is imminent. The board-binding system described in this application permits a "toe-edge" turn that puts the rider in the classic telemark position, a low, stable stance providing toe-edge pressure. The reverse, or heel-side turn, is more similar to the type of turn made by a snowboarder. It is accomplished by pushing off from the telemark position. That allows the rider to carve turns like a snowboarder, one of the most desirable features of the snowboard over other ski devices. But at the same time, the fast edge-to-edge action provided by the comparatively narrow width of the board and its steep sidecut lets the rider turn with the speed of the best skiers.

Typical mono-ski riders, their heels locked down in narrow stances in inflexible Alpine boots and bindings, cannot crouch far to lower their center of gravity when extra stability or speed is needed. In the side-by-side binding set-UPS of typical mono-skis, the weight of the rider moves backward as the rider bends his or her knees to increase speed, eventually raising the front of the board and causing a loss of steering control. The skiboard described in this application, in combination with its loose-heel Nordic binding system, allows the rider to virtually drop the back knee onto the center of the deck of the board while placing the rider's weight on the balls of both feet, providing full weight along an entire edge along with an extremely low center of gravity and sharply reduced air resistance for speed and stability. The system also allows the rider to shift weight dramatically forward and backward in a way that is impossible with lock-down Alpine bindings, because the Nordic bindings allow both heels to rise and fall. That mobility allows faster turns than possible on snowboards or even most skis.

The Nordic skiboard described in this application solves the principal deficiency of snowboards—slow turning speed due to width. That is accomplished through the combination of the skiboard's relatively narrow width and hour-glass shape with the use of two Nordic, or telemark, bindings. Those bindings are situated in acutely angled fore-and-aft positions on a single board when the two longitudinal halves of the divisible skiboard are combined, and at all times on the non-divisible skiboard embodiment. The relatively narrow skiboard described here, its width falling between that of a traditional Alpine ski and a free-carve snowboard, can be brought quickly from edge-to-edge.

The design width range of the skiboard is crucial to the success of this combination: If the board is too narrow, like that of a conventional ski, the bindings cannot be angled sufficiently and the stance is unstable as a result. If the board is too wide, approaching that of even the narrowest snowboard, the heel lift provided by the Nordic bindings becomes a disadvantage, rather than an advantage. The disadvantage arises because the heel-side edge on a wider board will not rise if the Telemark bindings are angled so the toe and heel of the boots rest on their respective edges. Thus both the functional width of the board and the functional angles of the bindings are circumscribed within relatively narrow ranges described in this application.

The subject skiboard's Nordic binding arrangement offers a significant departure and improvement over previous efforts at a fore-and-aft mono-ski binding arrangement. The Evans et al Solo Ski binding patent document, referred to above, stresses the desirability of heel lockdown and allowing the rear heel lateral movement. That follows the prevailing wisdom of the ski industry. Ever since lift-served areas were created, t has been an article of ski faith that heel lockdown, first on independent skis, then on mono-skis and snowboards, is the key to control. The Nordic skiboard design is based on a new concept: that vertical heel lift on both feet, such as that provided by telemark bindings, is an advantage on a single skiboard of its dimensions, because the heel-lift permits extreme forward-backward weight shifts At the same time, the skiboard described here does not permit the lateral foot movement promoted by the Evans Solo Ski binding system, in the belief that both vertical heel lift and lateral stability are both essential to a rider's control on a skiboard with fore-and aft binding arrangements.

Unlike previous and existing mono-skis, which feature releasable Alpine bindings, the skiboard described in this application employs non-release cable or telemark Nordic bindings. We believe that snowboard users have proven over the past decade that keeping both legs secured to a single board is the best way to prevent lower-body injury. The subject skiboard's Nordic binding system also allows the use of flexible Nordic boots, which permit the rider to bend the foot while raising the heel, and to weight the ball of the rear foot and the heel of the front foot to arc the board. This arrangement applies all the weight of the skier to the waist of the ski, making it easier to arc and turn than it would be with an Alpine binding arrangements. The flexibility of the telemark boots also makes them more comfortable to wear than typical hard-shell, inflexible Alpine ski boots.

The subject skiboard draws from the ancient roots of skiing—the loose-heel binding—to create a new, cutting edge snow sport. It employs a Nordic dual-ski binding system, with non-releasable, loose-heel bindings designed to accept a 75 mm or other Nordic telemark-style boot, in a new and unforeseen way. Mounted at acute angles on a single board of the subject skiboard's dimensional range, these simple, relatively primitive bindings are the key to a high-performance skiboard. The boots are readily available and may range from less-expensive flexible leather lace-UPS to hard-shell types hinged at the instep, depending on the preference of the rider.

The Nordic skiboard was designed on the premise that heel-lift is necessary for optimum control and turning ability on a single board of its dimensions. The initial reaction of skiers and ski experts is invariably skepticism, until they either use the new skiboard themselves or see an accomplished rider demonstrate his or her skill.

The skiboard described in this application is thus a novel combination of aspects of many ski disciplines. It draws on the snowboarding concept of offset bindings for powerful edging, but reduces the angle of that offset so the rider is forward facing, rather than standing sideways on the board. The subject skiboard's narrow profile allows this more forward stance, and also permits much faster turns than possible on a snowboard while still providing a snowboard's ability to "carve." Because of this forward stance, a rider of the subject skiboard, unlike a snowboarder, can comfortably use poles.

The Nordic skiboard described here improves on the traditional mono-ski because its angled fore-and-aft foot setup allows heavy edge pressure. It offers a significant departure from previous fore-and-aft mono-ski setups, which rely on Alpine skis and on Alpine boots and bindings, because it relies on Nordic boots and bindings and the heel lift they provide, and because the specially designed skiboard's wider top surface allows acute angling of the bindings while eliminating the potential for binding or boot drag on the snow surface.

Both the Nordic skiboard invention which is divisible into skis, and one-piece, or lift-served, version offer convenient and unique binding set-up features. On the divisible skiboard, a binding base plate connects the binding toe and heel pieces and also serves as a brace used to connect the two longitudinal halves that serve as independent skis. A sliding connecting stud in the stem allows the binding system to be fixed either for use on the independent skis or for use in connecting the longitudinal halves, or skis, and riding the resulting skiboard. On the downhill, or one-piece, model, a 10-hole insert pattern, in which the inserts are arranged in two groups of five, allows Nordic Norm bindings to be rapidly installed and strongly fixed in place for either right-foot or left-foot forward riding.

The construction of the Nordic skiboard itself involves no novel materials or techniques. It can be made by virtually any method commonly used to make skis or snowboards.

Turning now to the figures, the first embodiment of the invention is a single skiboard (FIGS. 1 and 2) that employs standard Nordic Norm telemark bindings (left binding illustrated in FIG. 15 by combination of a binding toe piece 108L and a heel cable 110L, and right binding by combination of a binding toe piece 108R and a heel cable 110R) or other loose-heel Nordic-style bindings, with binding toe pieces 108L and 108R set at acute angles to the axis of the ski one in front of the other. In this description the first embodiment of the skiboard is generally designated by reference numeral 100. This embodiment is intended primarily for use in lift-served ski areas.

The second embodiment of the invention (FIGS. 11 and 12), is generally designated by the reference numeral 200. It is a skiboard of like dimensions to skiboard embodiment 100, and also uses multiple arrangements of Nordic bindings. The primary difference from skiboard embodiment 100 is that embodiment 200 can, when desired, be separated into longitudinal halves 233L and 233R for use as independent skis (FIGS. 13 and 14). It is intended primarily for back-country use, where the user may want to be able to move his legs independently to glide over flat areas and up hills but retain the option of linking halves 233L and 233R into a single embodiment 200 (FIGS. 11 and 12) for control on steep descents.

Both skiboard embodiments 100 and 200 use standard Nordic Norm or other Nordic-style bindings, such as those in FIGS. 15, 23 and 24, designed for use with telemark boots (not shown). Both skiboard embodiments 100 and 200 may be constructed using a variety of standard ski construction methods well-known in the industry.

Because they do not lock down the rider's heels, standard Nordic Norm or telemark bindings, such as those illustrated in FIGS. 15, 23 and 24, will only function well on a skiboard falling within the specific parameters set in this description. On a wider skiboard, the loose-heel aspect of Nordic bindings would cause control problems, and a narrower board would be too unstable.

Referring to FIGS. 1 and 11, in skiboard embodiments 100 and 200 the maximum width of a front shovel area 104 and a rear shovel area 116 is 6 to 9 inches. The skiboard has a central portion with front and rear ends being between 23 centimeters in width. A waist 112, or narrowest portion, on skiboard embodiments 100 and 200 falls 0 to 12 centimeters behind their longitudinal midpoints.

The sidecut radius on skiboard embodiments 100 and 200, designated by R in FIG. 1, may vary from an arc describing a section of a circle with a radius of 3 meters to an arc describing a circle with a radius of 20 meters.

The lengths of skiboard embodiments 100 and 200 may range from 150 to 200 centimeters.

Referring to FIG. 3, the maximum unweighted arch or camber 109 of skiboard embodiments 100 and 200, which is measured off a horizontal plane on which a skiboard rests (not shown), ranges from 1 to 6 centimeters.

Referring to FIG. 1, on both skiboard embodiments 100 and 200 a front shovel area 104 begins to rise 7 to 11 centimeters back toward waist 112 from an imaginary vertical line (not shown) that intersects a front tip 102 when either embodiment 100 or 200 is placed on a horizontal plane. Front tip 102 rises to a point 2 to 6 centimeters above that plane.

Again referring to FIG. 1, a rear shovel area 116 begins to rise 6 to 9 centimeters back toward waist 112 from an imaginary vertical line (not shown) that intersects a rear tip 114 when either skiboard embodiments 100 or 200 is placed on a horizontal plane. Rear tip 114 rises to a point 1.5 to 5 centimeters above that plane.

Referring to FIG. 4, the thicknesses of skiboard embodiments 100 and 200 reach a maximum of 1 to 2.5 centimeters at waist 112 and, progressing toward tip 102, the thickness tapers progressively to between 0.5 and 1.5 centimeters at point 119, where front shovel area 104 (FIG. 1) begins to rise. From that point to tip 102, the thickness tapers progressively to between 0.25 and 1 centimeter. A similar taper occurs from waist 112 to rear tip 114. Additional thickness in the rear of waist 112—up to 30 percent more than that allowed in front of waist 112—is desirable for skiboards that will be used at high speeds. Overall thickness will affect stiffness, with softer skiboards more desirable for mogul skiing and stiffer skiboards preferable for speed.

Referring to FIG. 19, each of the two standard Nordic Norm or telemark binding toe pieces 108R and 108L to be used on skiboard embodiment 200 are mounted permanently by rivets or fasteners 111 to base plates 228R and 228L. Binding base plates 228R and 228L may be made of 0.25 to 0.5 centimeter rolled steel or aluminum in 4- to 8-centimeter widths, or other materials of dimensions that provide similar strength.

Referring to FIG. 15, binding base plates 228R and 228L serve to help connect skiboard halves 233R and 233L when they are combined for use as single skiboard 200 (also shown in FIGS. 11 and 12). Referring to FIG. 22, a preferred embodiment of binding assembly 246L includes toe piece 108L bound to binding base plate 238L by three rivets or fasteners 111, with heel cable 110L attached to binding toe piece 108L. Near the rear of binding base plate 228L is a longitudinal slot 238L that is 1 to 10 centimeters in length and 0.25 to 1 centimeter in width. In front of binding toe piece 108L, binding base plate 238L has a latitudinal slot that measures 1 centimeter to 5 centimeters in length and 0.25 to 1 centimeter in width. In one preferred embodiment (FIG. 22), longitudinal slot 238L is penetrated by a threaded bolt 230L with an elongated or square head which serves as a heel pad for the rider's boot (not shown). The elongated head of bolt 230L also allows the user to hand tighten it as a connector to any of several combinations of threaded t-nuts or other receivers 234A–H (FIG. 25) installed in the surface of skiboard embodiment 200.

There are many potential methods for connecting binding assemblies 246R and 246L in a variety of positions to the surface of skiboard embodiment 200. In the preferred embodiment illustrated in FIG. 17, latitudinal slot 236R (FIG. 19) is penetrated by a threaded wing nut 232R. Wing-nut 232R may be hand-tightened by the user to connect the front of binding assembly 246R (FIG. 22) to several combinations of threaded t-nuts or receivers 234A–H installed in the surface of the board (FIG. 25).

Referring to FIGS. 1 and 11, in preferred versions of skiboard embodiments 100 and 200 the binding toe pieces 108R and 108L are mounted at acute, nearly parallel angles ranging from 1 to 35 degrees off either side of the axis of the skiboard. The objective is to locate binding toe pieces 108R and 108L and the heels of the rider (not shown) as close as possible to the opposing edges of skiboards 100 and 200 without either of the binding toe pieces or the heels of the rider overlapping any edge more than 2 centimeters.

Referring to FIG. 1, in skiboard embodiments 100 and 200 the binding toe pieces 108R and 108L should be mounted so the narrowest portion of the skiboard, waist 112, falls between the heel of the front ski boot (not shown) and whichever binding toe piece is placed in the rear. When locked in binding toe piece 108L or 108R, the heel of the front boot (not shown) should fall 0 to 12 centimeters in front of an imaginary line drawn perpendicular to the axis of skiboard embodiments 100 or 200 at waist 112. When locked in binding toe piece 108R or 108L, the toe of the rear boot should lie 0 to 12 centimeters to the rear of waist 112. This binding arrangement allows a rider (not shown) to pressure waist 112 and thus arc either skiboard embodiment 100 or 200 properly in turns.

Referring to FIG. 6, on skiboard embodiment 100 threaded inserts or threaded t-nuts (represented in FIG. 17 at 240) are installed in a wood core (represented in FIG. 17 at 242) two five-hole patterns. The insert installation patterns shown in FIG. 6 allow typical three-hole Nordic Norm bindings to be quickly and securely attached with machine screws, bolts or other connectors (not shown) in either a right-foot-forward (FIG. 7) or left-foot-forward (FIG. 9) arrangement, depending on individual preferences. Referring to FIGS. 7 and 9, the front and rear insert patterns each have one of five threaded inserts, 122C and 124C, that can be used as one of the three anchor points required to attach the standard Nordic Norm toe piece in either the right-foot-forward (FIG. 7) or left-foot-forward (FIG. 9) fashion. This common hole eliminates the need to drill a structure-weakening sixth hole (not shown).

Referring to FIG. 7, the combination of inserts used for a right-foot-forward Nordic Norm binding toe piece arrangement is 122A, 122D and 122C for front binding toe piece 108R attachment and 124A, 124D and 124C for rear binding toe piece 108L attachment. Referring to FIG. 9, the combination of inserts used for a left-foot-forward Nordic Norm binding toe piece arrangement is 122B, 122C and 122E for the front binding toe piece 108L attachment and 124B, 124C and 124E for the rear binding toe piece 108R attachment.

Referring to FIG. 16, on one preferred embodiment of skiboard 200 binding assembly 246R is mounted for use on an independent ski, longitudinal half 233R, as follows: the front of binding assembly 246R is locked down by a 1 centimeter diameter hardened machine screw, wing-nut bolt or fastener 232R, which penetrates slot 236R and threads into t-nut 234D installed in the core (242 at FIG. 17) of longitudinal half 233R. The rear of binding assembly 246R is locked down similarly by machine screw or threaded wing-nut bolt 230R, which penetrates slot 238R and threads into t-nut 234H installed in the core of longitudinal half 233R. Referring to FIG. 25, left binding assembly 246L is attached to longitudinal half 233L in identical fashion but using t-nut locations 234C and 234G.

Referring to FIG. 15, when longitudinal halves 233R and 233L are connected for use as single skiboard 200 by a left-foot-forward rider, binding assembly 246L (also shown as a group of elements in FIG. 22) is mounted in the proper position by locking connector 232L down onto receiver 234B and by locking connector 230L down onto receiver 234E. Binding assembly 246R (shown as a group of elements in FIG. 22) is mounted in the proper position by locking connector 232R down onto receiver 234D and by locking connector 230R down onto receiver 234G. The right-foot-forward binding arrangement is accomplished in similar fashion, with binding assembly 246R being mounted in the forward position onto receivers 234A and 234D and binding assembly 246L being mounted onto receivers 234E and 234H.

The binding lock-down system described above for skiboard embodiment 200 may employ several variations. One preferred embodiment (FIG. 18) employs a plurality of posts 245 that protrude from the surface of the board and which fit through binding base plate slots 236R and L and 238R and L to position them where needed. In that embodiment, a threaded wing nut 248 and a threaded nut with an elongated head (as represented in 230L, FIG. 22) would be used to lock down binding assemblies 246R and 246L.

On skiboard embodiment 200 (FIG. 11), each of toe pieces, 108R and 108L, and their respective base plates, 228R and 228L, are connected permanently by three rivets or fasteners 111 and are moveable as binding assemblies 246R and 246L (detailed in FIGS. 15 and 22). Base plates 228R and 228L must be of suitably strong material, such as 0.5 centimeter by 4 centimeter plates of aluminum or stainless steel, because they are placed under stress when used as devices for connecting longitudinal halves 233R and 233L, as shown in FIG. 11.

Referring again to FIG. 11, skiboard embodiment 200 is joined by binding assemblies 246R and 246L and a plurality of other connectors or latches 226A–D (also shown in FIG. 25) mounted on the surfaces of skiboard embodiment 200. A variety of latches may be used, one preferred embodiment (FIG. 20) employing a stainless steel over-center draw latch. Referring to FIGS. 20 and 21, the latch body 252 is installed on the surface of longitudinal half 233L and keeper 256 is installed on the opposing surface of longitudinal half 233R. Latch arm 254 is extended to engage keeper 256 and then drawn down by depressing lever 250, thereby eliminating the intervening gap 258. The latches used should have a draw strength of at least 50 pounds to withstand the stresses of using the skiboard.

Skiboard embodiments 100 and 200 are may be constructed by virtually any of the methods common to the ski and snowboard manufacturing industry. A preferred embodiment involves a vertically laminated hardwood core sandwiched between layers of epoxy-soaked triaxial fiberglass fabric. The topsheet may be chemically treated polyamide material and the base material of extruded or sintered polyethylene with chemically etched surfaces to help adhesion of inks or epoxy. Standard steel ski edges should wrap all exposed edges of the base material. All requisite hardware may be fabricated easily by those skilled in the art or purchased from existing sources of supply.

The disclosed skiboard introduces a new winter sport. In its basic form, the skiboard is a device that allows the user in a lift-served ski area to carve hard, fast turns with the power of a snowboard and the speed of traditional downhill skis. In its divisible embodiment, it allows the user to penetrate remote back-country regions on independent cross-country style skis, which can be joined, using the same bindings, into a skiboard for control on steep downhill runs.

While the description above contains many specificities, these should not be construed as limitations on the scope of the invention, but rather as an exemplification of one preferred embodiment thereof. For example, the invention skiboard may use any loose-heel binding devices, such as 75 millimeter, three-pin telemark bindings with or without heel straps or cables, 75-millimeter cross-country ski bindings, step-in bindings that allow the heel of the boot to rise, NNN BC type telemark bindings, or strap devices designed to hold down the toe and instep of the rider while leaving the heel unfixed. The non-divisible embodiment of the subject skiboard may also be employed for back country use by fixing one foot in the front binding toe piece and the other on an auxiliary snow shoe.

Also, a wide variety of latches or connectors may be used to bind together the longitudinal halves, or skis, of the divisible embodiment of the skiboard. In addition to the over-center draw latches discussed in the description of invention section of this patent application and illustrated in the accompanying drawings, flexible rubber draw latches, bolt-action latches, a wide variety of slam-action or other latches, or straps may be used, in a variety of positions and numbers.

The devices used to connect the binding assemblies to the skiboard embodiments may include, in addition to those discussed above and shown in the accompanying drawings, any type of compact fastener or flat latching device designed to hold down the binding or binding assembly. Examples include quarter-turn fasteners, captive screws and cam locks.

Accordingly, the scope of the invention should be determined not by the embodiments illustrated but by the appended claims and their legal equivalents.

What is claimed is:

1. A skiboard comprising, in combination, a central portion of said skiboard, front and rear ends of said central portion being between 15 and 23 centimeters in width, said central portion having side edges and a central waist, said side edges having concave curvatures of a radius between 3 and 20 meters, said side edges extending between said front and rear ends of said central portion so that said concave curvatures of said side edges form said central waist, an upward curving front shovel area having a front tip and being formed by the front end of said central portion, said front shovel area curving upward from said central portion 7 to 11 centimeters behind said front tip so that said front tip is raised at least 2 centimeters, said skiboard being between 150 and 200 centimeters in length, said skiboard central portion having a longitudinal camber, said camber elevating said waist between 1 and 6 centimeters, left and right loose-heel binding devices having at least a toe portion and a front end of said toe portion, and means securing said binding devices to said central portion substantially parallel to each other and with one of said binding devices in front of said waist and one of said binding devices behind said waist, said skiboard having a longitudinal axis, said means releaseably and alternately securing said binding devices so that said binding devices are angled to the right of said axis when said left binding device is in front of said right binding device and said binding devices are angled to the left of said axis when said right binding device is secured in front of said left binding device at an acute angle less than 35 degrees from said axis.

2. The combination according to claim 1 with the addition of an upward curving rear shovel area having a rear tip and being formed at the rear of said central portion, said rear shovel area curving upward from said central portion between 6 and 9 centimeters from said rear tip so that said rear tip is raised at least 1.5 centimeters.

3. The combination according to claim 2 with the addition of three fastening means associated with each of said binding devices allowing removal and attachment of said binding devices, said fastening means having co-acting elements fixed to said binding devices and to said central portion of said skiboard, one of said co-acting elements of said fastening means for each of said binding devices being at said front end of said toe piece and two of said co-acting elements of said fastening means for each of said binding devices being spaced apart behind said front end of said toe piece, said co-acting elements of said fastening means being fixed to said central portion of said skiboard alternately securing each of said binding devices at an acute angle to the right and to the left of said longitudinal axis of said skiboard.

4. The combination according to claim 2 wherein said co-acting elements of said fastening means fixed to said central portion of said skiboard are in clusters of five to secure each of said binding devices, each of said clusters having two forwardly disposed spaced apart co-acting elements to selectively receive the co-acting element at the front end of one of said toe pieces, and each of said clusters having three rearwardly disposed co-acting elements, said three coacting elements having a center co-acting element and outwardly disposed co-acting elements disposed to each side thereof, said two spaced apart co-acting elements for each of said binding devices engaging said center co-acting element of said rearwardly disposed co-acting elements fixed to said central portion and one of said outwardly disposed co-acting elements fixed to said central portion.

5. A skiboard system comprising, a skiboard and left and right loose heel binding secured to said skiboard, said skiboard having:

a longitudinal axis;

a central portion having side edges and a central waist, said side edges having concave curvatures of radius, said side edges extending between front and rear ends of said central portion so that said concave curvatures of said side edges form said central waist, said central portion further having a longitudinal camber, said camber elevating said waist; and an upward curving front shovel area having a front tip and being formed by the front end of said central portion, and wherein said left and right loose heel bindings are secured to said central portion substantially parallel to each other on opposite sides of said waist at an acute angle less than 35 degrees from said longitudinal axis and wherein said bindings are angled to the right of said longitudinal axis when said left binding is in front of said waist and said bindings are angled to the left of said longitudinal axis when said right binding is secured in front of said waist.

* * * * *